US011815092B2

(12) United States Patent
Ikushima

(10) Patent No.: US 11,815,092 B2
(45) Date of Patent: Nov. 14, 2023

(54) FLUID TRANSFER DEVICE, COATING DEVICE COMPRISING SAME, AND COATING METHOD

(71) Applicant: MUSASHI ENGINEERING, INC., Mitaka (JP)

(72) Inventor: Kazumasa Ikushima, Mitaka (JP)

(73) Assignee: MUSASHI ENGINEERING, INC., Mitaka (JP)

( * ) Notice: Subject to any disclaimer, the term of this patent is extended or adjusted under 35 U.S.C. 154(b) by 0 days.

(21) Appl. No.: 18/044,983

(22) PCT Filed: Jan. 19, 2022

(86) PCT No.: PCT/JP2022/001827
§ 371 (c)(1),
(2) Date: Mar. 11, 2023

(87) PCT Pub. No.: WO2022/158492
PCT Pub. Date: Jul. 28, 2022

(65) Prior Publication Data

US 2023/0265848 A1 Aug. 24, 2023

(30) Foreign Application Priority Data

Jan. 19, 2021 (JP) ..... 2021-006131

(51) Int. Cl.
*F04C 15/00* (2006.01)
*F04C 2/107* (2006.01)
*B05C 5/02* (2006.01)

(52) U.S. Cl.
CPC ..... *F04C 15/0065* (2013.01); *B05C 5/025* (2013.01); *B05C 5/0225* (2013.01); *F04C 2/107* (2013.01)

(58) Field of Classification Search
CPC ..... B05C 5/0225; B05C 5/025; F04C 2/107; F04C 2/1071; F04C 2/1075; F04C 15/0065
(Continued)

(56) References Cited

U.S. PATENT DOCUMENTS 3,354,537 A * 11/1967 O'Connor ..... F04C 2/1075 29/402.09
4,773,834 A * 9/1988 Saruwatari ..... F04C 2/1071 418/153
(Continued)

FOREIGN PATENT DOCUMENTS

JP 2009-203958 A 9/2009
JP 2010-1876 A 1/2010
(Continued)

OTHER PUBLICATIONS

International Search Report dated Mar. 29, 2022, issued in counterpart International Application No. PCT/JP2022/001827.
(Continued)

*Primary Examiner* — Nathan H Empie
(74) *Attorney, Agent, or Firm* — WHDA, LLP

(57) ABSTRACT

Problem: To provide a fluid transfer device that can solve an issue of pulsation that occurs when a liquid material is discharged from a nozzle by eccentrically rotating a male-screw-shaped rotor within a stator having a female-screw-shaped insertion hole, an application device including the fluid transfer device, and an application method. Solution: A fluid transfer device 1 includes: an outer cylinder 10; a stator 11 that has a female-screw-shaped insertion hole 12 as a through-hole and is provided on an inner periphery of the outer cylinder; and a male-screw-shaped rotor 20 that is connected to a rotor driving part and eccentrically rotates in contact with an inner periphery of the stator. In the fluid transfer device 1 capable of transferring a fluid in a transport
(Continued)

path formed by the stator 11 and the rotor 20, by rotating the rotor 20 inserted through the insertion hole 12, contact force with the rotor 20 at an inlet portion and an outlet portion of the stator 11 is smaller than contact force with the rotor 20 at a central portion of the stator 11.

29 Claims, 8 Drawing Sheets

(58) Field of Classification Search
USPC ..... 418/48, 189, 194
See application file for complete search history.

(56) References Cited

U.S. PATENT DOCUMENTS 5,145,342 A * 9/1992 Gruber ..... F04C 2/1075 418/153
5,358,390 A * 10/1994 Jager ..... F04C 2/1073 418/48
5,722,820 A * 3/1998 Wild ..... F04C 2/1073 418/153
2017/0314551 A1 11/2017 Sakakihara et al.
2018/0223836 A1 8/2018 Sakakihara et al.
2018/0223837 A1 8/2018 Sakakihara et al.
2018/0223838 A1 8/2018 Sakakihara et al.

FOREIGN PATENT DOCUMENTS

JP 2010-248979 A 11/2010
JP 5802914 B1 11/2015
JP 2016-94907 A 5/2016
WO 2016/031646 A1 3/2016

OTHER PUBLICATIONS

Written Opinion by ISA dated Mar. 29, 2022, issued in counterpart International Application No. PCT/JP2022/001827 w machine translation.

* cited by examiner

[Fig.1]
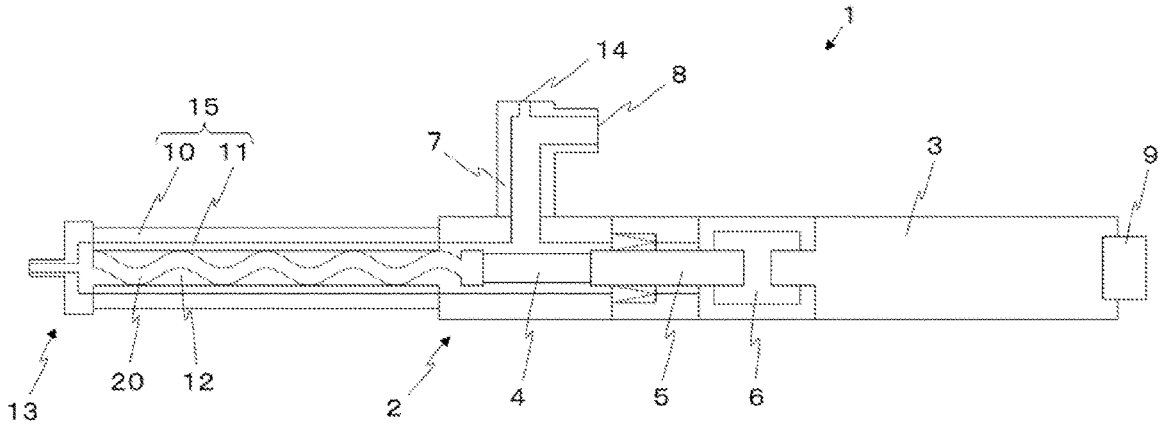
[Fig.2]
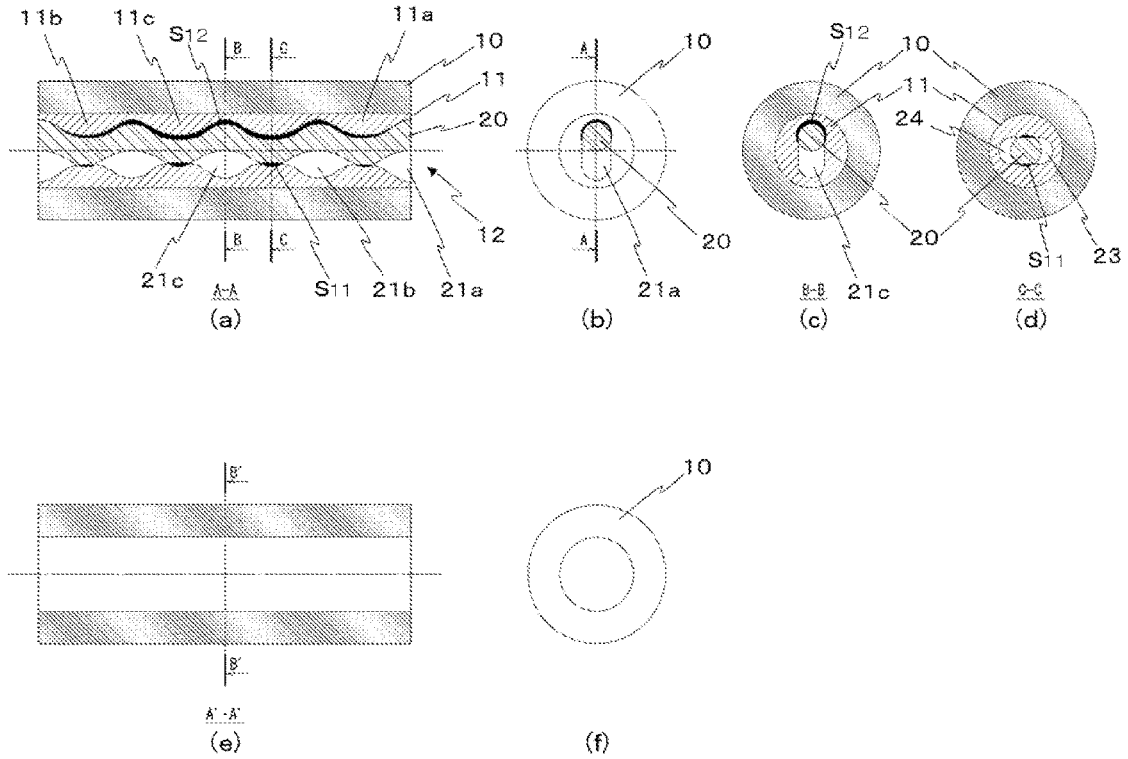

[Fig.3]
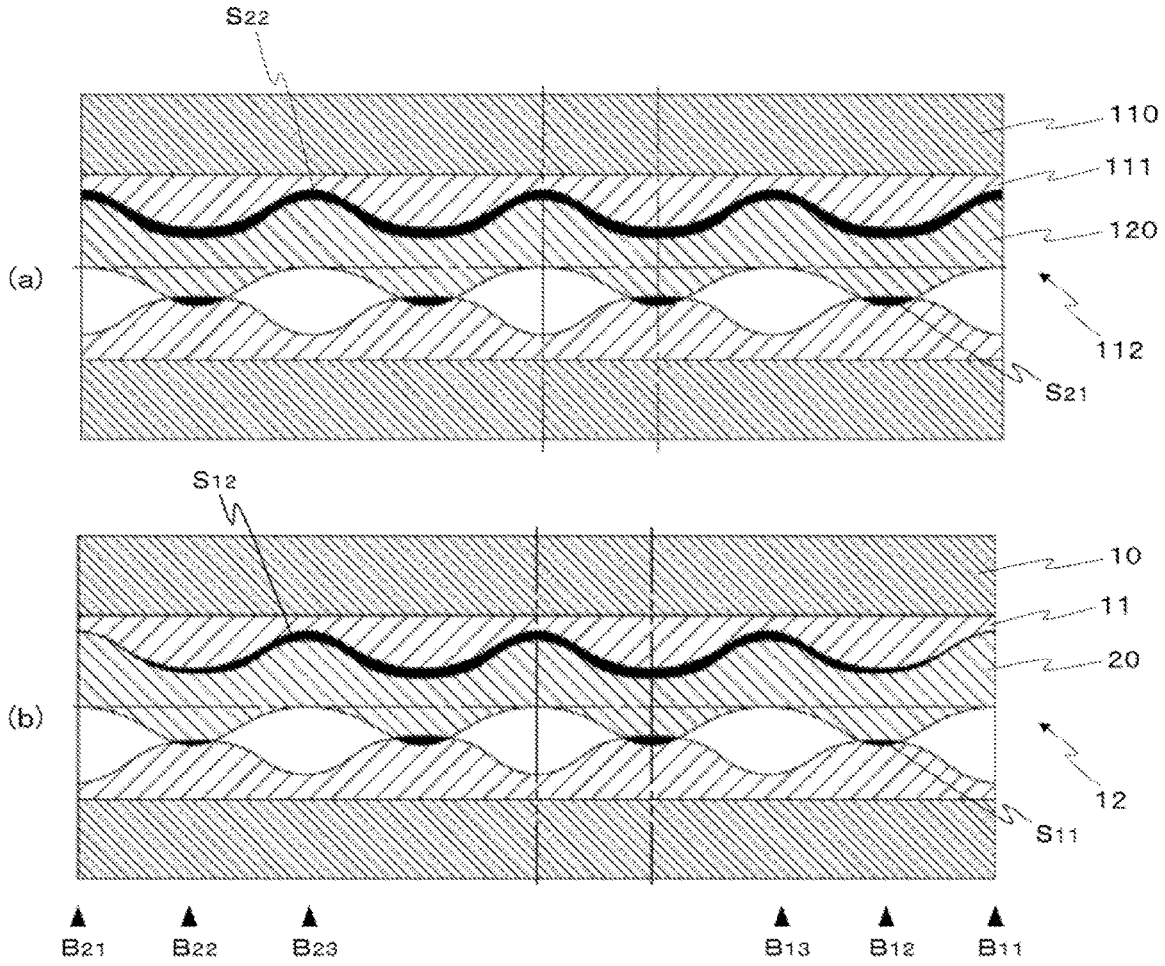
[Fig.4]
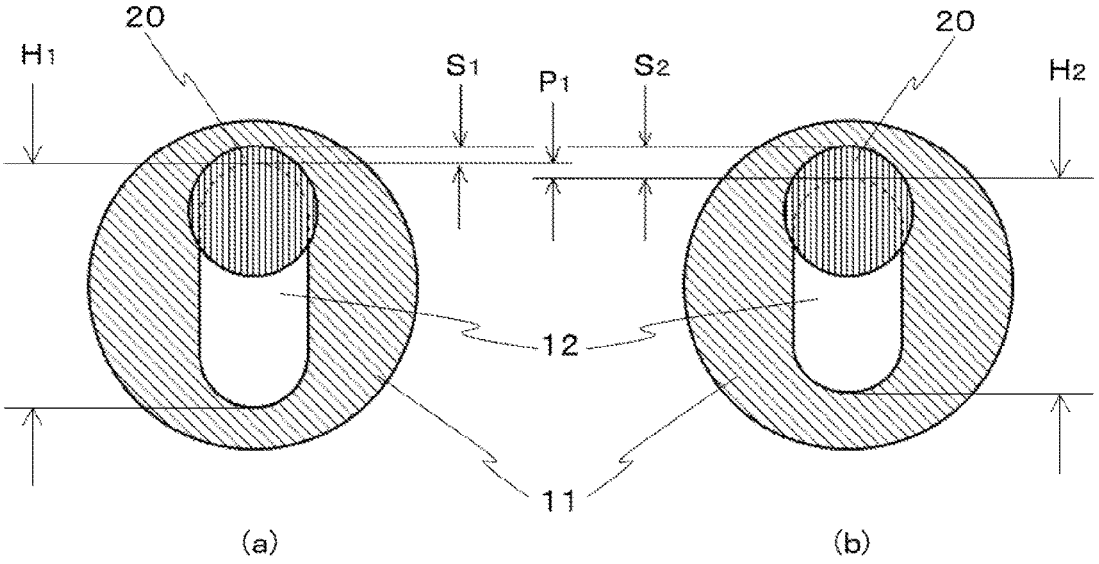

[Fig.5]
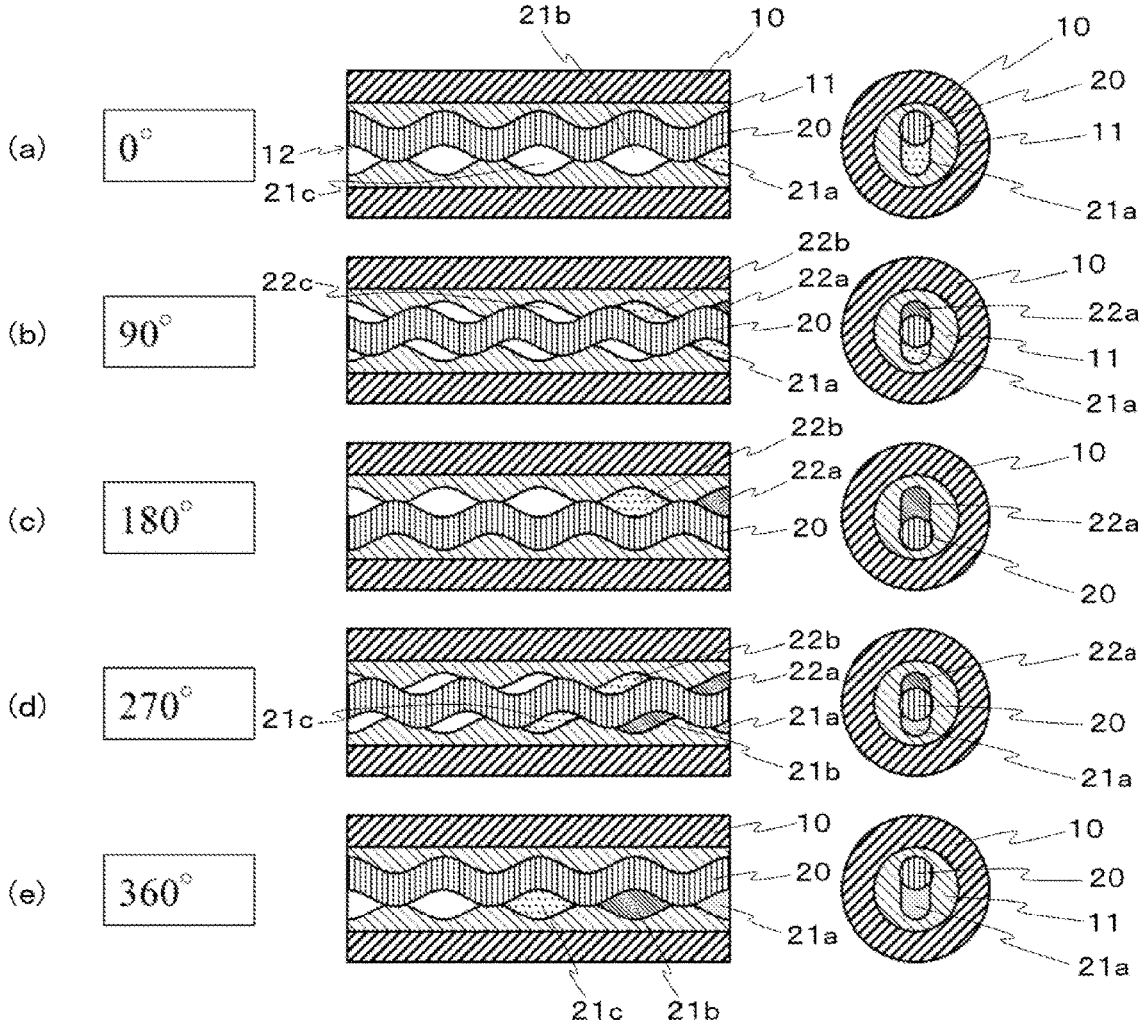

[Fig.6]
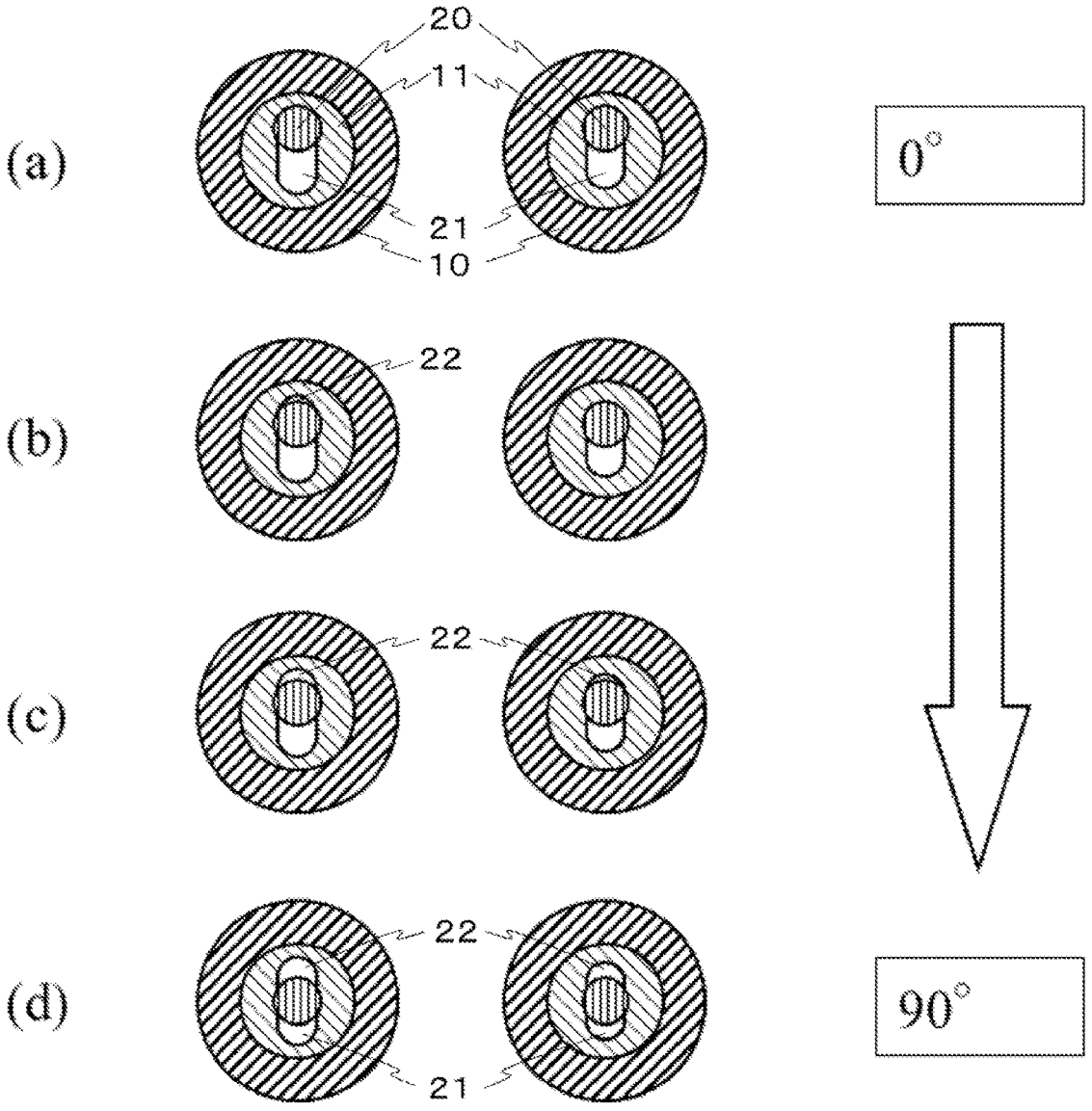

[Fig.7]
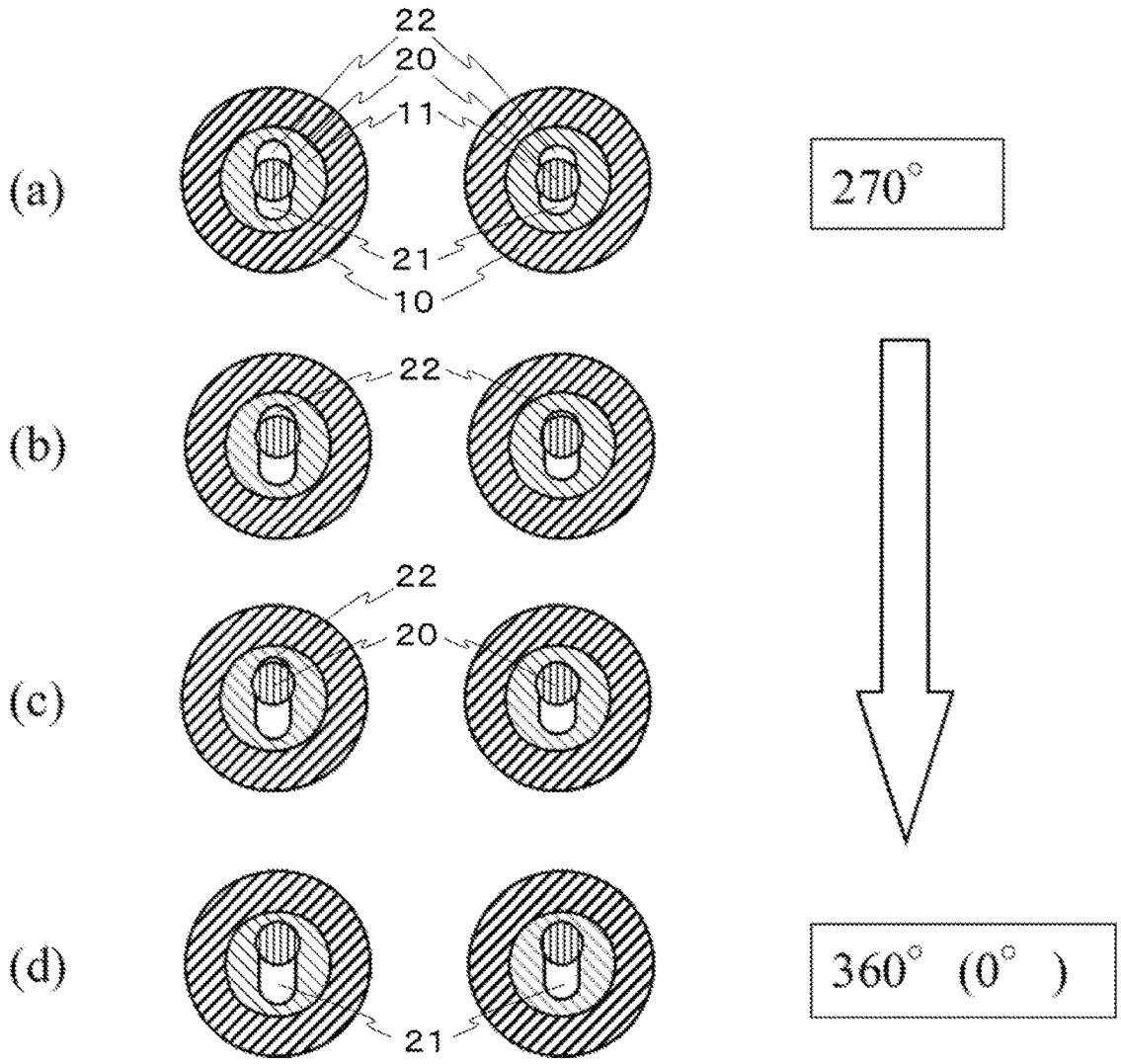

[Fig.8]
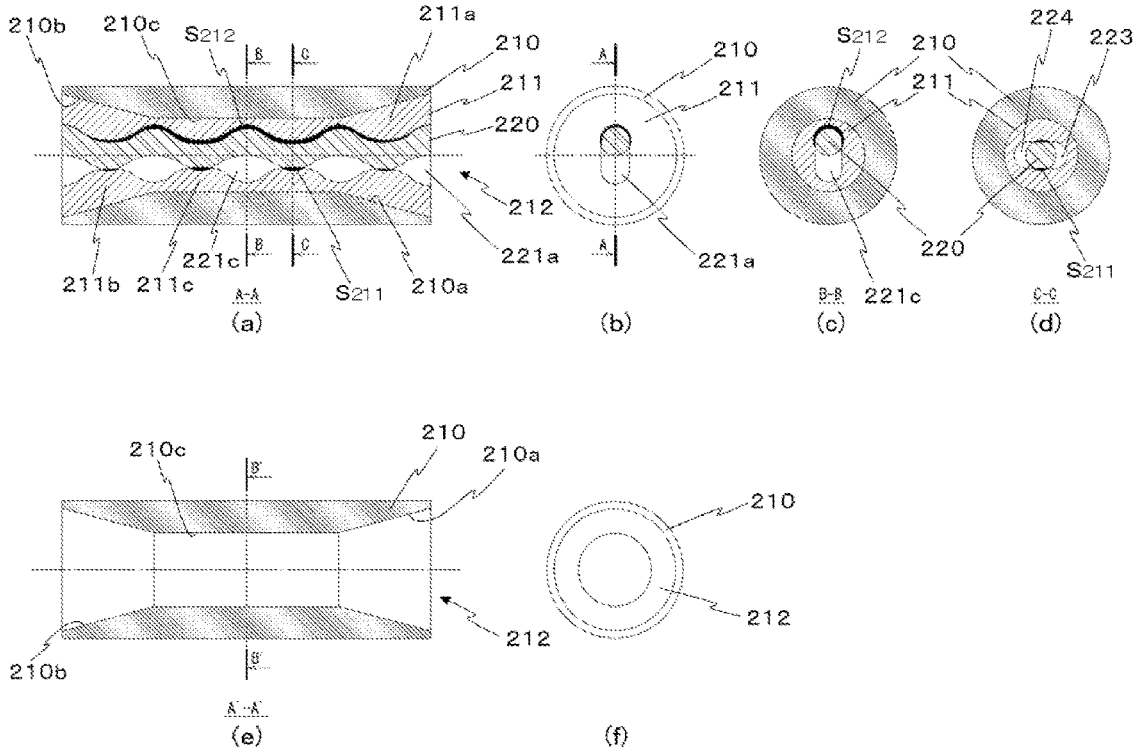
[Fig.9]
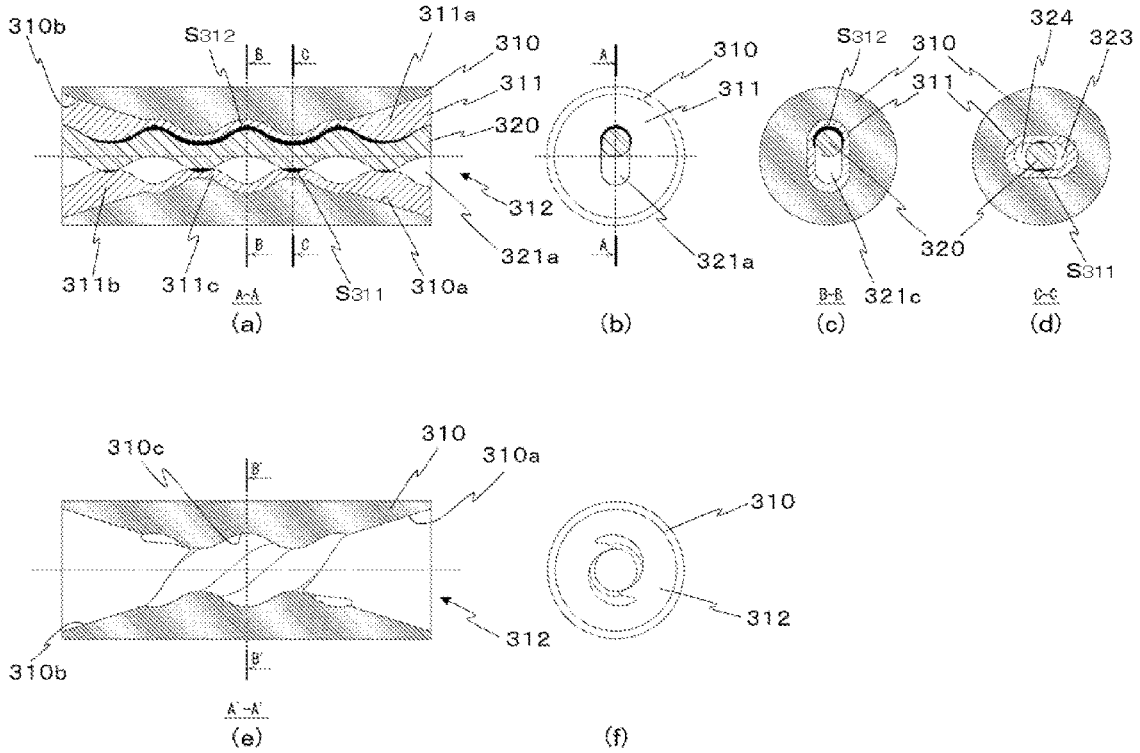

[Fig.10]
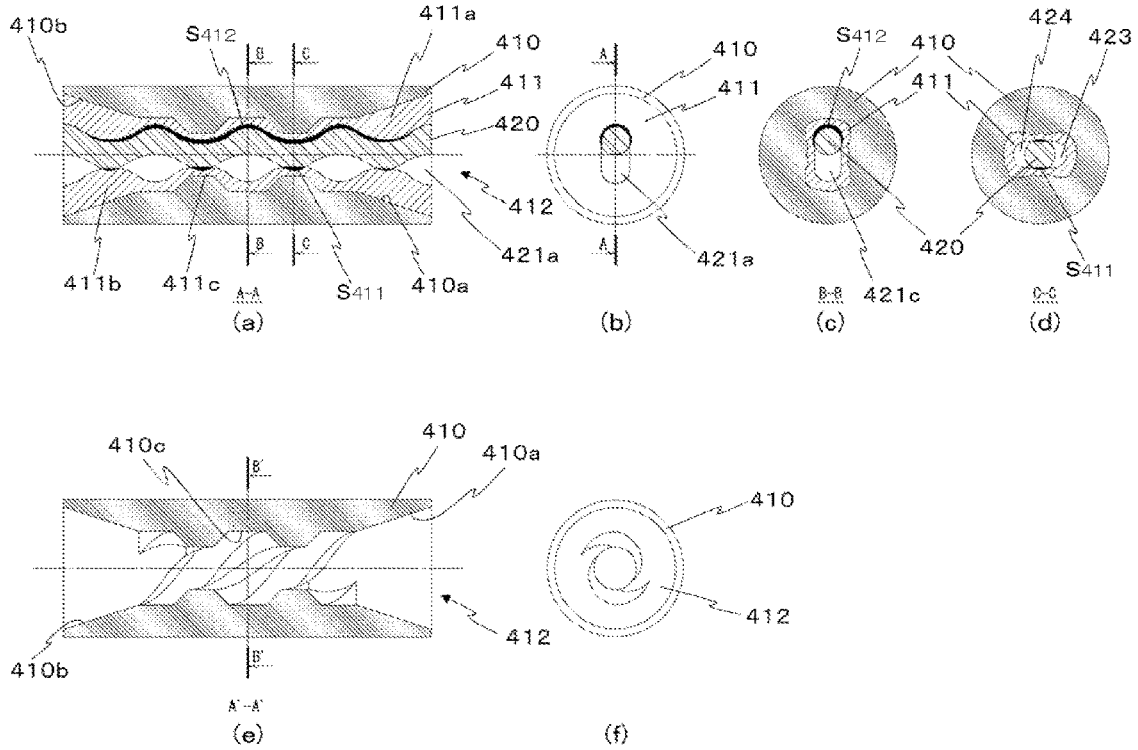
[Fig.11]
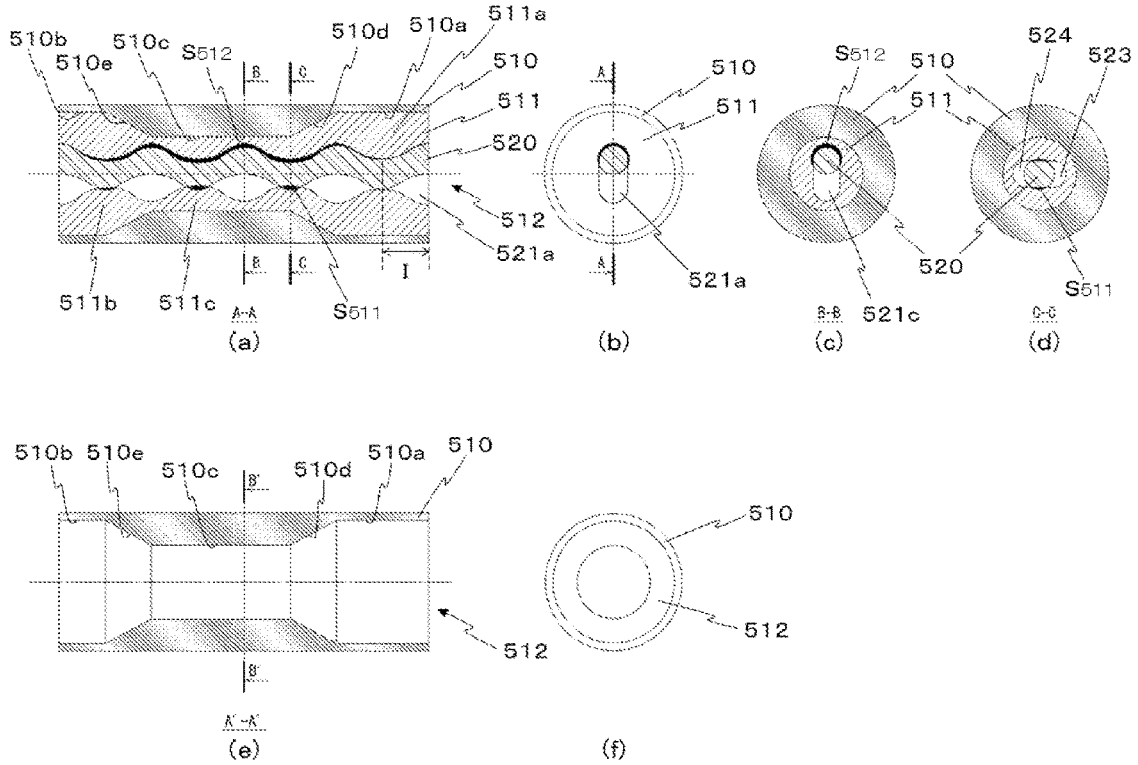

[Fig.12]
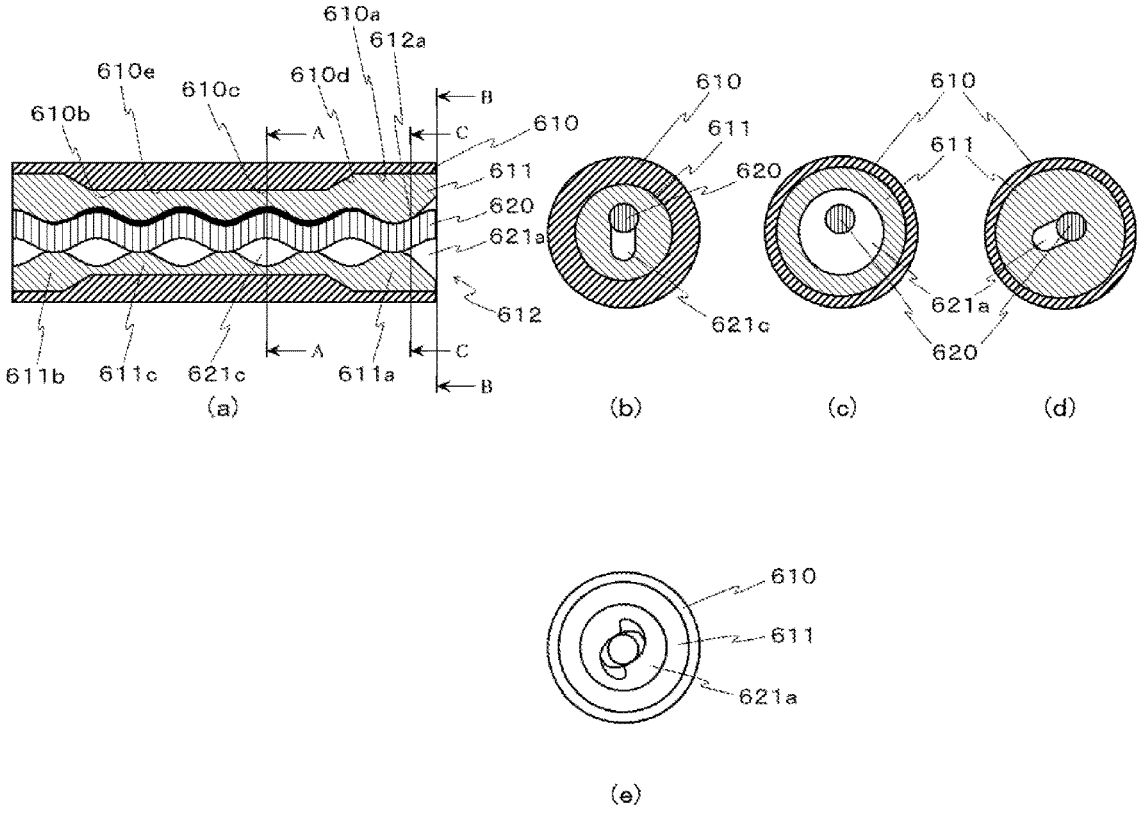

FLUID TRANSFER DEVICE, COATING DEVICE COMPRISING SAME, AND COATING METHOD

DESCRIPTION

Technical Field

The present invention relates to a fluid transfer device capable of pumping out a fluid by uniaxially eccentrically rotating a male-screw-shaped rotor in contact with an inner periphery of a stator, an application device including the fluid transfer device, and an application method.

Background Art

There has been known a device including a rotor as a uniaxial eccentric screw and a stator through which the rotor is inserted, which transports a liquid material or fluid. This sort of device is referred to as a uniaxial eccentric screw pump or also Mohno Pump. The stator of the device has interference for tightening (interference) that elastically deforms due to rotation of the rotor, and transports the liquid material or fluid by taking advantage of the elastic action of the stator.

For example, Patent Document 1 discloses a fluid transport device in which the capacity of a transport space formed by a through-hole of a stator is arranged to decrease toward a flow direction from an inlet port to a discharge port in order to solve a problem of bubble generation that occurs when a fluid that is highly volatile or contains a large amount of dissolved gas is discharged.

Furthermore, Patent Document 2 discloses a uniaxial eccentric screw pump in which interference on a discharge port side is arranged to be smaller than interference on an inlet port side in order to prevent a problem of a stator crack or breakage that occurs when it is used under a situation where capacity efficiency of a fluid transport path is less than one and discharge pressure is high.

Prior Art List

Patent Document

Patent Document 1: Japanese Patent Publication No. 5802914

Patent Document 2: Japanese Patent Laid-Open Publication No. 2010-248979

SUMMARY OF THE INVENTION

Problems to be Solved by the Invention

However, the devices in the above documents have an issue that, when the fluid is discharged from the discharge port, pulsation occurs and uniformly metered discharge cannot be performed.

In a case where the device in the above documents is incorporated into a fluid circulation circuit to be used as a circulation pump, there is an issue that a flow in the circulation circuit pulsates and is not kept constant.

In a case where the device in the above documents is used to discharge a liquid material onto a work surface, there is an issue that pulsation when a line is drawn on the work surface will cause a non-uniform line width.

Therefore, an object of the present invention is to provide a fluid transfer device that can solve an issue of pulsation that occurs when a fluid is pumped out by eccentrically rotating a male-screw-shaped rotor within a stator having a female-screw-shaped insertion hole, an application device including the fluid transfer device, and an application method.

Means for Solving the Problems

A fluid transfer device according to the present invention is a fluid transfer device including: an outer cylinder; a stator that has an insertion hole as a female-screw-shaped through-hole and is provided on an inner periphery of the outer cylinder; and a male-screw-shaped rotor that is connected to a rotor driving part and eccentrically rotates in contact with an inner periphery of the stator, wherein the fluid transfer device is capable of transferring a fluid in a transport path formed by the stator and the rotor, by eccentrically rotating the rotor inserted through the insertion hole, wherein the stator includes an inlet portion that spans a certain range through a longitudinal direction from an inlet of the transport path, an outlet portion that spans a certain range through the longitudinal direction from an outlet of the transport path, and a central portion located between the inlet portion and the outlet portion, wherein the stator is subject to smaller contact force by the rotor at the inlet portion and the outlet portion than contact force by the rotor at the central portion.

In the fluid transfer device, the stator may have a smaller amount of interference by the rotor at the inlet portion and the outlet portion than an amount of interference by the rotor at the central portion, whereby the stator may be subject to smaller contact force by the rotor at the inlet portion and the outlet portion than contact force by the rotor at the central portion.

In the fluid transfer device, an amount of interference by the rotor may decrease gradually from the central portion toward the outlet or the inlet.

In the fluid transfer device, contact force by the rotor at the central portion may be uniform through the longitudinal direction.

In the fluid transfer device, (A) contact force A1, A2, A3, A4 may satisfy a relationship A4>A2>A3>A1, where A1 denotes contact force between the rotor and the stator at the inlet of the transport path, A2 denotes contact force between the rotor and the stator at a position that is one turn of the rotor from the inlet of the transport path, A3 denotes contact force between the rotor and the stator at a position between the inlet of the transport path and the position that is one turn of the rotor from the inlet of the transport path, and A4 denotes contact force between the rotor and the stator at a longitudinally central portion of the transport path, and (B) contact force B1, B2, B3, B4 may satisfy a relationship B4>B2>B3>B1, where B1 denotes contact force between the rotor and the stator at the outlet of the transport path, B2 denotes contact force between the rotor and the stator at a position that is one turn of the rotor from the outlet of the transport path, B3 denotes contact force between the rotor and the stator at a position between the outlet of the transport path and the position that is one turn of the rotor from the inlet of the transport path, and B4 denotes contact force between the rotor and the stator at the longitudinally central portion of the transport path.

In the fluid transfer device, an amount of interference by the rotor at a longitudinally central portion of the insertion hole may be uniform through the longitudinal direction.

In the fluid transfer device, (A) amounts of interference A1, A2, A3, A4 may satisfy a relationship A4>A2>A3>A1, where A1 denotes an amount of interference between the rotor and the stator at the inlet of the transport path, A2 denotes an amount of interference between the rotor and the stator at a position that is one turn of the rotor from the inlet of the transport path, A3 denotes an amount of interference between the rotor and the stator at a position between the inlet of the transport path and the position that is one turn of the rotor from the inlet of the transport path, and A4 denotes an amount of interference between the rotor and the stator at a longitudinally central portion of the transport path, and (B) amounts of interference B1, B2, B3, B4 may satisfy a relationship B4>B2>B3>B1, where B1 denotes an amount of interference between the rotor and the stator at the outlet of the transport path, B2 denotes an amount of interference between the rotor and the stator at a position that is one turn of the rotor from the outlet of the transport path, B3 denotes an amount of interference between the rotor and the stator at a position between the outlet of the transport path and the position that is one turn of the rotor from the inlet of the transport path, and B4 denotes an amount of interference between the rotor and the stator at the longitudinally central portion of the transport path.

In the fluid transfer device, a longitudinally central portion of the insertion hole may span a range of two turns of the rotor or more.

In the fluid transfer device, the inlet portion may be within a range exceeding one turn of the rotor from the inlet of the transport path, and the outlet portion may be within a range exceeding one turn of the rotor from the outlet of the transport path.

In the fluid transfer device, a longitudinal range of the central portion of the stator may be longer than respective longitudinal ranges of the inlet portion and the outlet portion.

In the fluid transfer device, an interference amount ratio of interference by the rotor at the inlet portion and the outlet portion of the stator to interference by the rotor at the central portion of the stator may be within 0.4:1 to 0.7:1.

In the fluid transfer device, a shape and/or a material property of the inlet portion and the outlet portion of the stator may be specified differently from the central portion of the stator such that contact force with the rotor at the inlet portion and the outlet portion is smaller than contact force with the rotor at the central portion.

In the fluid transfer device, either one element of a material property and a thickness of the stator, along with an amount of interference of the stator, at an inlet portion of the transport path, may be specified differently from a central portion of the insertion hole such that contact force with the rotor at the inlet portion of the stator is smaller than contact force with the rotor at the central portion of the stator, and either one element of a material property and a thickness of the stator, along with an amount of interference of the stator, at an outlet portion of the transport path, may be specified differently from the central portion of the insertion hole such that contact force with the rotor at the outlet portion of the stator is smaller than contact force with the rotor at the central portion of the stator.

In the fluid transfer device, the longitudinally central portion of the stator may be made of material with greater elasticity than material of the inlet portion and/or the outlet portion of the stator.

In the fluid transfer device, an upstream end portion and a downstream end portion of the outer cylinder may have inner peripheries with a larger diameter than a longitudinally central portion of the outer cylinder.

In the fluid transfer device, the longitudinally central portion of the outer cylinder may have an inner periphery with a constant diameter.

In the fluid transfer device, the longitudinally central portion of the outer cylinder may have a female-screw-shaped inner periphery with a same pitch as the stator.

In the fluid transfer device, an outer periphery of the outer cylinder may have an uneven shape at a position corresponding to the female-screw-shaped inner periphery.

In the fluid transfer device, the inner periphery at the upstream end portion of the outer cylinder may be formed by a tapered surface of which diameter increases toward an upstream end of the outer cylinder, and the inner periphery at the downstream end portion of the outer cylinder may be formed by a tapered surface of which diameter increases toward a downstream end of the outer cylinder.

In the fluid transfer device, the outer cylinder may include an upstream end portion inner periphery of which inner periphery diameter is constant, an inlet-side tapered surface connecting the upstream end portion inner periphery with the central portion, a downstream end portion inner periphery of which inner periphery diameter is constant, and an outlet-side tapered surface connecting the downstream end portion inner periphery with the central portion.

In the fluid transfer device, a range of the inner periphery with the larger diameter at the upstream end portion of the outer cylinder may be longer than a range of the inner periphery with the larger diameter at the downstream end portion of the outer cylinder.

In the fluid transfer device, a ratio of a range of the inlet portion of the stator to a range of the central portion of the stator may be within 3:5 to 3:10, and a ratio of a range of the outlet portion of the stator to the range of the central portion of the stator may be within 2:5 to 2:10.

In the fluid transfer device, the stator may include a transport action zone having interference by the rotor and a non-transport action zone that is located on an upstream side from the transport action zone and is not in contact (has no interference) with the rotor.

In the fluid transfer device, an inner periphery of the insertion hole constituting the non-transport action zone may be formed by a tapered surface of which diameter increases from a center side of the insertion hole toward an inlet side.

In the fluid transfer device, a capacity of the non-transport action zone may be smaller than a capacity of any of transport spaces within the insertion hole that are located in the transport action zone and are opened and closed by eccentric rotation of the rotor.

In the fluid transfer device, contact force with the rotor at the inlet portion and/or the outlet portion of the stator may be weakest when the rotor is at a highest position and a lowest position.

In the fluid transfer device, the fluid transfer device may be a liquid-material discharge device further including a nozzle member having a discharge port through which the fluid flowing out from the outlet of the transport path is discharged.

An application device according to the present invention is an application device including: the fluid transfer device described above; and a relative movement device that moves the fluid transfer device and an application target relative to each other.

An application method according to the present invention is an application method of drawing a line with a uniform width on a work surface using the application device described above.

Advantageous Effect of the Invention

According to the present invention, it is possible to solve an issue of pulsation that occurs in a pumped-out fluid when the fluid is pumped out by eccentrically rotating a rotor within a stator.

BRIEF DESCRIPTION OF THE DRAWINGS

FIG. 1 is a partial sectional side view of a liquid-material discharge device according to a first embodiment.

FIG. 2 illustrates explanatory views of an outer cylinder, a stator, and a rotor according to the first embodiment. (a) is a side sectional view when the rotor is at its highest position (0°), (b) is a back view, (c) is a B-B sectional view of (a), (d) is a C-C sectional view of (a), (e) is a side sectional view of the outer cylinder only, and (f) is a back view of the outer cylinder only.

FIG. 3 (a) is a sectional view of an outer cylinder, a stator, and a rotor according to a related art, and (b) is a sectional view of the outer cylinder, the stator, and the rotor according to the first embodiment.

FIG. 4 illustrates sectional views for explaining interference of the stator according to the first embodiment. (a) is a front sectional view of an inlet portion of the stator, and (b) is a front sectional view of a longitudinally central portion of the stator.

FIG. 5 illustrates sectional views of the outer cylinder, the stator, and the rotor according to the first embodiment. (a) is a side sectional view and a front sectional view when the rotor is at 0° position, (b) is a side sectional view and a front sectional view when the rotor is at 90° position, (c) is a side sectional view and a front sectional view when the rotor is at 180° position, (d) is a side sectional view and a front sectional view when the rotor is at 270° position, and (e) is a side sectional view and a front sectional view when the rotor is at 360° position.

FIG. 6 is a comparison diagram for explaining formation situations of transport spaces from 0° to 90° for a configuration with small interference of the stator (left diagram) and a configuration with large interference (right diagram). (a) is front sectional views when the rotor is at 0° , (b) is front sectional views when the rotor rotates from (a), (c) is front sectional views when the rotor further rotates from (b), and (d) is front sectional views when the rotor is at 90°.

FIG. 7 is a comparison diagram for explaining formation situations of transport spaces from 270° to 360° for the configuration with small interference of the stator (left diagram) and the configuration with large interference (right diagram). (a) is front sectional views when the rotor is at 270° , (b) is front sectional views when the rotor rotates from (a), (c) is front sectional views when the rotor further rotates from (b), and (d) is front sectional views when the rotor is at 360° (0°).

FIG. 8 illustrates explanatory views of an outer cylinder, a stator, and a rotor according to a second embodiment. (a) is a side sectional view when the rotor is at its highest position (0°), (b) is a back view, (c) is a B-B sectional view of (a), (d) is a C-C sectional view of (a), (e) is a side sectional view of the outer cylinder only, and (f) is a back view of the outer cylinder only.

FIG. 9 illustrates explanatory views of an outer cylinder, a stator, and a rotor according to a third embodiment. (a) is a side sectional view when the rotor is at its highest position (0°), (b) is a back view, (c) is a B-B sectional view of (a), (d) is a C-C sectional view of (a), (e) is a side sectional view of the outer cylinder only, and (f) is a back view of the outer cylinder only.

FIG. 10 illustrates explanatory views of an outer cylinder, a stator, and a rotor according to a fourth embodiment. (a) is a side sectional view when the rotor is at its highest position (0°), (b) is a back view, (c) is a B-B sectional view of (a), (d) is a C-C sectional view of (a), (e) is a side sectional view of the outer cylinder only, and (f) is a back view of the outer cylinder only.

FIG. 11 illustrates explanatory views of an outer cylinder, a stator, and a rotor according to a fifth embodiment. (a) is a side sectional view when the rotor is at its highest position (0°), (b) is a back view, (c) is a B-B sectional view of (a), (d) is a C-C sectional view of (a), (e) is a side sectional view of the outer cylinder only, and (f) is a back view of the outer cylinder only.

FIG. 12 illustrates explanatory views of an outer cylinder, a stator, and a rotor according to a sixth embodiment. (a) is a side sectional view when the rotor is at its highest position (0°), (b) is an A-A sectional view of (a), (c) is a B-B sectional view of (a), (d) is a C-C sectional view of (a), and (e) is a back view with the rotor omitted.

Mode for Carrying out the Invention

Embodiments of a fluid transfer device of the present invention will be described below using a liquid-material discharge device as an example. Note that a technical idea of the present invention can be applied not only to the liquid-material discharge device but also to, for example, a circulation pump incorporated into a fluid circulation circuit. In addition, a fluid to be transferred by the fluid transfer device is not limited to a liquid material, and may be a fluid object such as powder and paste.

<First Embodiment>

FIG. 1 is a partial sectional side view of a liquid-material discharge device 1 according to a first embodiment. Hereinafter, for convenience of explanation, a nozzle member 13 side may be referred to as a front side (front) and an opposite side to the nozzle member 13 may be referred to as a rear side (back).

The liquid-material discharge device 1 includes a rotor driving device 3 provided on the rear side of a main body 2, and a stator unit 15 provide on the front side.

The main body 2 is hollow and houses a coupling member 4 and a shaft 5 inside. A rear-side end portion of the shaft 5 is coupled to the rotor driving device 3 via a coupling 6, and driving force from the rotor driving device 3 is transmitted thereto. Rotation of the shaft 5 by the rotor driving device 3 causes a rotor 20 connected to the shaft via the coupling member 4 to eccentrically rotate. The rotor driving device 3 may be combined with a versatile external rotating device. In addition, a supply tube 7 is connected to a top surface of the main body 2, and a liquid material is supplied from a reservoir not shown to a liquid-material supply port 8. Here, the liquid material within the reservoir may be pressurized by a compressed air, a piston, or the like. A top of the supply tube 7 is provided with a bubble releasing hole 14. The bubble releasing hole 14 may be plugged during use. A back-end portion of the main body 2 is a connector 9 to which a power supply cable (not shown) is connected.

The stator unit 15 includes a stator 11 and an outer cylinder 10 that fixes the stator 11. The stator unit 15 is detachably fixed to the rotor driving device 3 with known means such as a screw clamp or a chuck so that slippage, backlash, and the like will not occur even when the rotor 20 rotates within the stator 11 by being driven by the rotor driving device 3 as described above.

The outer cylinder 10 is a cylindrical body made of metal, ceramics, or the like, and has a constant thickness from a front-end portion to a back-end portion in the present embodiment. Since the outer cylinder 10 tightly fixes the stator 11, even when the rotor 20 to be described later rotates within the stator 11 by being driven by the rotor driving device 3, neither slippage of the stator 11 within the outer cylinder 10 nor gap between the stator and the outer cylinder 10 occurs. A front-side end portion of the outer cylinder 10 communicates with the nozzle member 13 having a liquid-material outlet (discharge port). The liquid-material discharge device 1 of the present embodiment is held such that a work as an application target and the nozzle member 13 face each other at an arbitrary angle to be used. An outer peripheral shape of the outer cylinder 10 is straight with a constant diameter in FIG. 1, but is not limited to the illustrated shape, and may include, for example, a step or a curve. Moreover, the outer peripheral shape may have unevenness along unevenness of an inner periphery of the outer cylinder 10 so that the inner periphery of the outer cylinder 10 will be made visible. Furthermore, an outer periphery of the outer cylinder 10 may be provided with a groove, a thread, a flange, or the like. It should be noted that, since the outer cylinder 10 and the stator 11 are roughly depicted in FIG. 1, detailed description thereof will be given with reference to FIG. 2 and subsequent figures.

FIG. 2 illustrates explanatory views of the outer cylinder 10, the stator 11, and the rotor 20 according to the first embodiment. (a) is a side sectional view when the rotor 20 is at its highest position (0°), (b) is a back view, (c) is a B-B sectional view of (a), (d) is a C-C sectional view of (a), (e) is a side sectional view of the outer cylinder 10 only, and (f) is a back view of the outer cylinder 10 only. In FIG. 2 (a) and (e), an insertion hole 12 has an outlet in a left end surface and an inlet in a right end surface.

As shown in FIG. 2 (a), the stator 11 is arranged within the outer cylinder 10 in tight contact with the inner periphery of the outer cylinder 10. The stator 11 has the insertion hole 12 having an inner periphery like a female screw, and forms a transport path in cooperation with the rotor 20 that is arranged within the insertion hole 12 and has an outer periphery like a male screw. That is, the transport path is a flow path formed by the stator 11 and the rotor 20, and appears only in a state where the rotor 20 is inserted through the stator 11. In FIG. 2 (a), the right end of the outer cylinder 10 is a start position of the transport path (inlet of the transport path), and the left end of the outer cylinder 10 is an end position of the transport path (outlet of the transport path). A transport action zone is configured where the rotor 20 eccentrically rotating within the insertion hole 12 slides in tight contact with the fixed stator 11 so as to transfer a liquid material within the transport path. In the present embodiment, the insertion hole 12 from the right end to the left end constitutes the transport action zone (it should be noted that an insertion hole 12 illustrated in FIG. 12 to be described later also includes a non-transport action zone).

The stator 11 is an elastic body made of elastic material such as rubber or resin. The stator 11 has interference (interference for tightening) that elastically deforms when pressed by the rotor 20 inserted through the insertion hole 12, and transports the liquid material within the insertion hole 12 by elastic action caused by rotation of the rotor 20. Here, interference (interference for tightening) is "tightening tolerance" and means an overlap thickness (dimensional difference, amount of interference). In the present embodiment, the inner periphery of the stator 11 has a shape of a female screw with two threads and has a constant pitch within a range where it is in contact with the rotor 20.

It should be noted that the female screw shape of the stator 11 is not limited to the example shape of the female screw with two threads, and can be a shape of any female screw. The number of threads of the stator 11, if changed, can be n+1, which is the number n of threads of the rotor 20 plus one. Furthermore, the winding direction of the female screw of the stator 11 may be counterclockwise (left-hand screw) or clockwise (right-hand screw). In the specification, a clockwise stator with respect to an advancing direction of the liquid material will be described.

The rotor 20 has a shape of a male screw with one thread. The rotor 20 is arranged within the insertion hole 12 of the stator 11, and eccentrically rotates to dynamically form two lines of transport paths within the insertion hole 12. In more detail, cavities (closed spaces) with a phase shift of 180° in a rotation period of the rotor 20 are alternately formed in the two lines of transport paths. The cavities filled with the liquid material moves from the inlet side to the outlet side, and the liquid material is thereby transported. A rear-side end portion of the rotor 20 is coupled to the shaft 5 via the coupling member 4, and the rotor 20 eccentrically rotates when driving force from the rotor driving device 3 is transmitted to the shaft 5. The rotor 20 has a constant diameter and a constant pitch at least within a range where it is in contact with the stator 11.

It should be noted that the male screw shape of the rotor 20 is not limited to the shape of the male screw with one thread, and can be a shape of any male screw to match the shape of the inner periphery of the stator 11. In the present embodiment, the male screw shape of the outer periphery of the rotor 20 is illustrated as being uniform in its longitudinal direction, but may not be uniform. It is possible to make interference thicker at a central portion of the transport path and thinner at both of end portions by forming the inner periphery of the stator 11 into a female screw shape depending on the male screw shape of the outer periphery of the rotor 20.

As illustrated in FIG. 2 (b), when the rotor 20 is at its highest position, a transport space 21*a* that has the maximum opening area and forms a first-line cavity is formed below the rotor 20 at an inlet portion, to which the liquid material is supplied from the supply tube 7. When the rotor 20 rotates from the illustrated position, a transport space 22*a* (see FIG. 5 to be described later) that forms a second-line cavity is dynamically formed above the rotor 20 at the inlet portion, and the opening area of the transport space 21*a* shrinks.

As illustrated in FIG. 2 (c), when the rotor 20 is at its highest position, a transport space 21*c* that forms a first-line cavity is formed below the rotor 20 at a B-B line position (see FIG. 5 (a)). When the rotor 20 rotates from the illustrated position, while a sectional area of the transport space 21*c* below the rotor 20 shrinks, a transport space 22*c* that forms a second-line cavity is created above the rotor 20 and a sectional area thereof further expands along with the rotation of the rotor 20 (see FIG. 5 (b) to be described later).

As illustrated in FIG. 2 (d), when the rotor 20 is at its highest position, transport spaces 23, 24 are formed on the right and left sides of the rotor 20 at a C-C line position. Here, the transport space 23 communicates with transport spaces 21*c* and 22*b* to form the first-line cavity, and the transport space 24 communicates with transport spaces 21*b* and 22*c* to form the second-line cavity (for positions of the transport spaces 21*b*, 21*c*, 22*b*, 22*c*, see FIG. 5). When the rotor 20 rotates from the illustrated position, a sectional area of one of the transport spaces 23, 24 on the right and left sides of the rotor 20 shrinks, and a sectional area of the other expands. For example, when the rotor 20 rotates from 0° to 90°, the transport space 23 is closed and the sectional area of the transport space 24 is maximized.

In this way, the rotation of the rotor 20 causes repetition of the motion of forming and closing transport spaces of the two lines at opposite positions across the rotor 20 in each section (including the B-B section and the C-C section) perpendicular to a flow-path direction of the stator 11, resulting in movement of the cavities filled with the liquid material toward the outlet side. The liquid material that has been transported through the two lines of transport paths within the insertion hole 12 merges and is discharged from the nozzle member 13. In order to prevent pulsation of the liquid material transported through the two lines of transport paths, it is necessary to supply a sufficient amount of liquid material to fully fill each cavity of each transport path, and to ensure smooth confluence of the liquid material transported through the two lines of transport paths. In order to realize these conditions, it is important to adjust contact force between the rotor 20 and the stator 11 at an inlet portion and an outlet portion of the insertion hole 12.

(Adjustment of Contact Force of Stator)

The present invention solves an issue of pulsation by making tightening force of the stator in an area where the rotor and the stator are in contact with each other smaller at both of end portions than at a central portion thereof. In other words, an issue of pulsation is solved by arranging distribution of contact force between the rotor and the stator over the longitudinal direction such that the contact force is smaller at both of the end portions than at the central portion of the stator. The stator 11 can be divided into three regions in terms of the contact force with the rotor 20. That is, the stator 11 can be divided into a central portion where the contact force with the rotor 20 is constant, an inlet portion (region on the inlet side from the central portion) where the contact force with the rotor 20 is smaller than at the central portion, and an outlet portion (region on the outlet side from the central portion) where the contact force with the rotor 20 is smaller than at the central portion. In the example of FIG. 3 (b), the portion between $B_{13}$ and $B_{23}$ is the central portion, the portion between $B_{13}$ and $B_{11}$ is the inlet portion, and the portion between $B_{23}$ and $B_{21}$ is the outlet portion.

The contact force of the stator can be adjusted by adjusting a shape of the stator (for example, an amount of interference, thickness) and/or a material property of the stator (for example, repulsive force (rebound resilience), hardness). In the first embodiment, the contact force of the stator 11 corresponding to the above-described three regions is realized by adjusting the amount of interference. That is, compared to the central portion where the amount of interference is constant over the longitudinal direction of the stator 11, the contact force is adjusted by making the amount of interference smaller at both of the end portions so that the issue of pulsation is solved. A method of adjusting the contact force of the stator 11 in the first embodiment will be described in detail below with reference to FIGS. 2 to 4.

The area of the stator 11 in contact with the rotor 20 is pressed by the rotor 20 to constitute interference $S_{11}$, $S_{12}$. As can be seen from the interference $S_{11}$, $S_{12}$ drawn in black in FIG. 2 (a), in the first embodiment, the stator 11 arranged in tight contact with the inner periphery of the outer cylinder 10 has the interference $S_{11}$, $S_{12}$ that is smaller near both of the end portions than at the longitudinally central portion. Here, the longitudinal direction of the stator 11 means the same direction as a direction from an inlet toward an outlet or a direction from the outlet toward the inlet, and is a direction perpendicular to a radial direction. The stator 11 includes a central portion 11*c* where the amount of interference is constant, an inlet portion 11*a* where the amount of interference decreases gradually (stepwise) from the central portion 11*c* toward the inlet (upstream), and an outlet portion 11*b* where the amount of interference similarly decreases gradually (stepwise) from the central portion 11*c* toward the outlet (downstream). The stator thickness is made thinner at the inlet portion 11*a* and the outlet portion 11*b* of the stator 11 than at the central portion 11*c* to achieve the smaller amount of interference. Thus, the contact force between the rotor 20 and the stator 11 is weaker at the inlet portion and the outlet portion than at the central portion 11*c*. In the first embodiment, a quantitative interference ratio of both of the end portions to the longitudinally central portion of the stator 11 is, for example, end portions: central portion=0.4:1 to 0.7:1. It should be noted that longitudinal ranges (longitudinal lengths) of the inlet portion 11*a* and the outlet portion 11*b* of the stator 11 are the same as ranges (longitudinal lengths) of the inlet portion and the outlet portion of the insertion hole 12.

FIG. 3 (a) is a side sectional view of an outer cylinder 110, a stator 111, and a rotor 120 according to a related art, and (b) is a side sectional view of the outer cylinder 10, the stator 11, and the rotor 20 according to the first embodiment. As can be seen from interference $S_{21}$, $S_{22}$ drawn in black in FIG. 3 (a), in the related art, an inner periphery of the outer cylinder 110 has a constant diameter in the longitudinal direction, and an inner periphery (female screw shape) of the stator 111 arranged inside thereof is also uniformly formed in the longitudinal direction. Furthermore, a male screw shape of an outer periphery of the rotor 120 is uniformly formed in the longitudinal direction. Thus, interference formed by the rotor 120 and the stator 11 in cooperation is also constant. That is, an amount of the interference $S_{21}$, $S_{22}$ is constant throughout the longitudinal direction of the outer cylinder 110. For this reason, the related art has an issue that pulsation easily occurs when the liquid material that has passed through the two lines of transport paths merges.

In addition, the related art also has an issue that pulsation easily occurs due to insufficient supply of the liquid material to an inlet of the stator 111. Specifically, while the rotor 120 operates within a range of the interference, there occurs a time period when the liquid material is not supplied to a transport space. For example, in a case of a device where an opening of the inlet of the stator 111 is closed by interference when the rotor is at 355° position, the liquid material is not supplied during the rotation from 355° to 360° (and from 0° to 5°). Decrease in a supply amount of the liquid material by an amount during the rotation from 355° to 360° (and from 0° to 5°) leads to decrease in a discharge amount since a decreased amount of liquid material is transported, which causes pulsation.

On the other hand, in the first embodiment, as can be seen from the interference $S_{11}$, $S_{12}$ drawn in black in FIG. 3 (b), the range of the interference $S_{11}$, $S_{12}$ is smaller near both of the ends of the outer cylinder 10 than at the central portion. In more detail, an inner diameter size of the outer cylinder 10 is constant through the longitudinal direction, but a diameter of the inner periphery (female screw shape) of the stator 11 arranged inside thereof increases stepwise from the position $B_{13}$ on the right side of a central portion of the insertion hole 12 toward the position $B_{11}$ of the inlet. Thus, the amount of interference formed by the rotor 20 and the stator 11 in cooperation decreases toward the inlet ($B_{13}>B_{12}>B_{11}$). Also in the outlet portion, the diameter of the inner periphery (female screw shape) of the stator 11 similarly increases stepwise from the position $B_{23}$ on the left side of the central portion of the insertion hole 12 toward the position $B_{21}$ of the outlet. Thus, the amount of interference formed in cooperation with the rotor 20 decreases toward the outlet ($B_{23}>B_{22}>B_{21}$). For this reason, in the first embodiment, it is possible to solve the issue that pulsation easily occurs when the liquid material that has passed through the two lines of transport paths merges and the issue that pulsation easily occurs due to insufficient supply of the liquid material to the inlet of the stator. For example, in the present invention, assuming that the rotor's highest position is 360° position, a state where the liquid material is supplied to a transport space at the inlet-side end portion (inlet of the transport path) continues till the rotor reaches 358° (preferably, till it reaches 359°, more preferably, till immediately before it reaches 360°). Similarly, a state where the liquid material is supplied to a transport space of the other line at the inlet-side end portion (inlet of the transport path) continues till the rotor reaches 178°(preferably, till it reaches 179°, more preferably, till immediately before it reaches 180°).

FIG. 4 (a) is a sectional view at the inlet portion of the insertion hole 12 when the rotor 20 is at its highest position (0°), and FIG. 4 (b) is a sectional view at the longitudinally central portion of the insertion hole 12 when the rotor 20 is at its highest position (0°). A movement length necessary for opening the inlet portion of the insertion hole 12 (from $S_1$ to an opening position $H_1$) in FIG. 4 (a) is shorter than a movement length necessary for opening the longitudinally central portion of the insertion hole 12 (from $S_2$ to an opening position $H_2$) in FIG. 4 (b), although respective positions of the upper end of the rotor 20 are the same. That is, interference $S_1$ (FIG. 4 (a)) at the inlet portion of the insertion hole 12 is smaller than interference $S_2$ (FIG. 4 (b)) at the central portion by $P_1$, and thus the liquid material is more easily supplied to the inlet of the transport path.

From a viewpoint of accepting more liquid material into a cavity without delay, it is important to open the inlet of the transport path promptly (shorten the closed time period).

(Liquid-material Transport Action)

A liquid-material transport action caused by the rotating motion of the rotor 20 will be described with reference to FIG. 5.

As illustrated in FIG. 5 (a), when the rotor 20 is at 0° position (highest position), a transport space 21*a* that forms a cavity appears below the rotor 20 at the most upstream point, and the transport space 21*a* is filled with the liquid material supplied from the supply tube 7. When the rotor 20 is at 0° position, a transport space above the rotor 20 is closed.

As illustrated in FIG. 5 (b), when the rotor 20 rotates to 90° position, a transport space 22*a* that forms a cavity appears above the rotor 20 at the most upstream point. Here, the most upstream transport space 22*a* is also filled with the liquid material supplied from the supply tube 7. A transport space 22*b* links with the transport space 21*a* below the rotor 20 on the near side in a depth direction of the paper of the figure (on the left side as viewed from the inlet side) to form the cavity (see the transport space 24 in FIG. 2 (d)). Along with decrease in a sectional region of the transport space 21*a* below the rotor 20, the liquid material present in the transport space 21*a* moves toward the transport space 22*b*. It should be noted that, for the purpose of explanation, the transport space 21*a* and the transport space 22*b* that form the single cavity are denoted with respective different numerals. The same applies hereinafter.

As illustrated in FIG. 5 (c), when the rotor 20 rotates to 180° position (lowest position), the transport space 22*a* above the rotor 20 has the maximum opening as can be seen from the front sectional view. On the other hand, the transport space 21*a* below the rotor 20 is closed, and the liquid material that has been present in the transport space 21*a* moves toward the transport space 22*b*. The transport space 22*a* with the maximum opening is filled with the liquid material supplied from the supply tube 7.

As illustrated in FIG. 5 (d), when the rotor 20 rotates to 270° position, a sectional region of the transport space 22*a* that forms the cavity above the rotor 20 decreases. The transport space 22*a* links with a transport space 21*b* below the rotor 20 on the far side in the depth direction of the paper of the figure (on the right side as viewed from the inlet side) to form the cavity (see the transport space 23 in FIG. 2 (d)). Along with decrease in the sectional region of the transport space 22*a*, the liquid material present in the transport space 22*a* moves toward the transport space 21*b*. Furthermore, along with decrease in a sectional region of the transport space 22*b*, the liquid material present in the transport space 22*b* moves toward a transport space 21*c*. When the transport space 21*a* reappears below the rotor 20 at the most upstream point, the transport space 21*a* is filled with the liquid material supplied from the supply tube 7.

As illustrated in FIG. 5 (e), when the rotor 20 rotates to 360° position, the transport space 22*a* that forms the cavity above the rotor 20 is closed. In this process, the liquid material that has been present in the transport space 22*b* moves toward the transport space 21*c*, and the liquid material that has been present in the transport space 22*a* moves toward the transport space 21*b*. When the transport space 21*a* reappears below the rotor 20 at the most upstream point, the transport space 21*a* is filled with the liquid material supplied from the supply tube 7. Here, the transport spaces 21*a*, 21*b*, 21*c*, . . . that have appeared below the rotor 20 form respective cavities divided by tight contact between the rotor 20 and the stator 11.

As described above, the liquid material is transported from the inlet side toward the outlet side within the insertion hole 12 by repeating the rotating motion of the rotor 20 from 0° to 360°. When the liquid material is transported by rotating the rotor 20, it is important to fill the cavities with the sufficient amount of the liquid material in order to prevent pulsation. Especially, it is preferable to arrange the contact force with the stator 11 when the rotor 20 is at its highest position (0°) and lowest position (180°) to be smaller.

(Relationship between Amount of Interference and Transport Space)

Supplementary explanation will be given about a formation situation of a transport space in a configuration with small interference and a configuration with large interference with reference to FIGS. 6 to 7.

FIG. 6 is a comparison diagram for explaining formation situations of transport spaces from 0° to 90° for the configuration with small interference of the stator 11 (left diagram) and the configuration with large interference (right diagram).

As illustrated in FIG. 6 (a), when the rotor 20 is at its highest position (0°), no transport space is formed above the rotor 20 both in the configuration with small interference (left diagram) and the configuration with large interference (right diagram).

As illustrated in FIG. 6 (b), when the rotor 20 rotates and is somewhat lowered from its highest position, a transport space 22 is formed above the rotor 20 in the configuration with small interference (left diagram). Meanwhile, in the configuration with large interference (right diagram), the transport space 22 is not formed above the rotor 20.

As illustrated in FIG. 6 (c), when the rotor 20 further rotates, the transport space 22 is formed above the rotor 20 also in the configuration with large interference (right diagram). Meanwhile, in the configuration with small interference (left diagram), the transport space 22 above the rotor 20 forms a larger section than that in the configuration with large interference (right diagram).

As illustrated in FIG. 6 (d), when the rotor 20 rotates 90° , transport spaces 21, 22 of which sections are the same in size are formed above and below the rotor 20 both in the configuration with small interference (left diagram) and the configuration with large interference (right diagram).

As can be seen from FIG. 6, the small interference of the stator 11 results in prompt elimination of tight contact between the rotor 20 and the stator 11. Especially, adopting the configuration with small interference at the outlet portion of the stator 11 is preferable because the prompt elimination of the tight contact between the rotor 20 and the stator 11 allows the liquid material within the cavities formed within the transport paths to flow out without delay.

FIG. 7 is a comparison diagram for explaining formation situations of transport spaces from 270° to 360° for the configuration with small interference of the stator 11 (left diagram) and the configuration with large interference (right diagram).

As illustrated in FIG. 7 (a), when the rotor 20 rotates 270° , the transport spaces 21, 22 of which sections are the same in size are formed above and below the rotor 20 both in the configuration with small interference (left diagram) and the configuration with large interference (right diagram).

As illustrated in FIG. 7 (b), in a state where the rotor 20 has rotated slightly from 270° , the sectional region of the transport space 22 above the rotor 20 has decreased also in the configuration with large interference (right diagram). Meanwhile, in the configuration with small interference (left diagram), the transport space 22 of which sectional region is larger than that in the configuration with large interference (right diagram) is maintained above the rotor 20.

As illustrated in FIG. 7 (c), when the rotor 20 further rotates and gets somewhat closer to its highest position, the sectional region of the transport space 22 above the rotor 20 decreases but is not closed in the configuration with small interference (left diagram). Meanwhile, in the configuration with large interference (right diagram), the transport space 22 above the rotor 20 is closed.

As illustrated in FIG. 7 (d), when the rotor 20 is at its highest position (360°(0°)), the transport space above the rotor 20 is closed both in the configuration with small interference (left diagram) and the configuration with large interference (right diagram).

As can be seen from FIG. 7, the large interference would result in early start of contact with the stator 11 by the rotation of the rotor 20 (see FIG. 7 (c)). At the portion where the rotor 20 and the stator 11 are in contact with each other, the transport space is closed and the liquid material stops filling the stator 11 from the inlet. However, as the rotor 20 further continues to rotate and expand a capacity of the cavity that is already closed until it reaches the tightest contact position (FIG. 7 (d)), a cavity insufficiently filled with the liquid material is sometimes formed. When the cavity insufficiently filled with the liquid material is opened to the nozzle member 13 at the outlet portion of the stator 11, it may draw the liquid material from the discharge port of the nozzle member 13, which causes pulsation. That is, an advantageous effect to eliminate pulsation can be obtained by decreasing interference and always forming a cavity fully filled with the liquid material.

(Range where Interference is Relatively Small)

Supplementary explanation will be given about a range where interference is relatively small in the stator 11. A "range" to be described below is a range of length in the longitudinal direction of the stator 11 unless otherwise specified.

In the first embodiment, interference is provided throughout the longitudinal direction of the stator 11, and a longitudinal range of interference at the central portion of the stator 11 is longer than respective longitudinal ranges of interference at the inlet portion and the outlet portion of the stator 11. In the example of FIG. 3 (b), the portion from $B_{13}$ to $B_{23}$ is the longitudinally central portion of the transport path formed in the insertion hole 12, the portion from $B_{11}$ to $B_{13}$ is the inlet portion of the transport path formed in the insertion hole 12, and the portion from $B_{21}$ to $B_{23}$ is the outlet portion of the transport path formed in the insertion hole 12.

Cavities within the two lines of transport paths advance with a phase shift of 180° in terms of the rotation of the rotor 20. Thus, when seeking to always obtain the advantageous effect by smaller interference in one of the two lines of transport paths, it is only necessary to make interference small in a range of one turn of the rotor 20 from each end portion of the transport path within the stator 11. When seeking to always obtain the advantageous effect by smaller interference both in the two lines of transport paths, it is necessary to make interference small in a range of one to two turns of the rotor 20 from each end portion of the transport path within the stator 11.

A purpose of the smaller interference at the inlet portion of the stator 11 is to ensure that the liquid material is sufficiently supplied to the inlet of the transport path. In order to achieve this purpose, it is sufficient to make interference small in a range of one turn of the rotor 20 or more from the inlet-side end portion of the stator 11, preferably, 1.2 turns of the rotor 20 or more from the inlet-side end portion, and more preferably, 1.5 turns of the rotor 20 or more from the inlet-side end portion.

On the other hand, a purpose of the smaller interference at the outlet portion of the stator 11 is to ensure that the liquid material within the cavities can smoothly move to the nozzle member 13. In order to achieve this purpose, it is sufficient to always obtain the advantageous effect by smaller interference in one of the two lines of transport paths, and thus it is sufficient to make interference small in the range of one turn of the rotor 20 from the outlet-side end portion of the stator 11. Smaller interference within such a range can prevent pulsation.

The functional advantage by smaller interference works within a range where the rotor 20 and the stator 11 are in tight contact with each other. For example, when the insertion hole 12 includes a range where the rotor 20 and the stator 11 are not in contact with each other at all times (non-transport action zone) due to chamfered parts or the like, the rest near the center (transport action zone) other than that range is subject to the advantage.

The rotor 20 in this device is two turns long at the shortest. Here, in order to surely transport the liquid material in the central portion of the transport path, a range of the longitudinally central portion of the stator 11 is preferably two turns of the rotor or more. Furthermore, the whole stator 11 and the whole rotor 20 are preferably four turns long or more, and more preferably, 4.5 turns long or more in consideration of manufacturing tolerance of an elastic body. From another viewpoint, the range of the longitudinally central portion of the stator 11 is preferably longer than any of the ranges of the inlet portion and the outlet portion of the stator 11. Then, in order to obtain the advantageous effect of the present invention, when the length (range) of the central portion of the stator 11 is the shortest, the ratio of inlet portion: central portion: outlet portion is 1:2:1, and the proportion of the central portion may be two or more. From a viewpoint where the range of the inlet portion is preferably longer than the range of the outlet portion, when the length of the central portion of the stator 11 is the shortest, the ratio of inlet portion: central portion: outlet portion=3:5:2, and the proportion of the central portion may be five or more.

From another viewpoint, it is disclosed that a ratio of the longitudinal range of the inlet portion of the stator 11 to the longitudinal range of the central portion is within 3:5 to 3:10, and a ratio of the longitudinal range of the outlet portion to the central portion of the stator 11 is within 2:2 to 2:10. Again, the longitudinal range of the inlet portion of the stator 1 is preferably longer than the longitudinal range of the outlet portion of the stator 1.

In addition, in the first embodiment, amounts of interference near both of the end portions of the stator 11 decrease stepwise (in other words, gradually) toward the end portions. In the example of FIG. 3 (b), assuming that there are three segments along the longitudinal direction in the inlet portion (or outlet portion) of the stator 11, an amount of interference at the inlet position $B_{11}$ (or outlet position $B_{21}$) is the smallest, and an amount of interference at the midpoint position $B_{12}$ of the inlet portion (or midpoint position $B_{22}$ of the outlet portion) is the second smallest. When there is such a variation in the amount of interference, the amount of interference can be said to decrease stepwise. However, the concept of decreasing an amount of interference stepwise (in other words, gradually) in the present invention is not limited to the illustrated mode. The present invention also includes a mode where an amount of interference decreases steplessly or unevenly stepwise at the inlet portion and the outlet portion of the stator 11.

As described above, in the first embodiment, the interference $S_{11}$, $S_{12}$ is smaller near both of the end portions of the stator 11 than at the central portion so that the contact force can be smaller near both of the end portions of the stator 11 than at the central portion. Therefore, the problem of pulsation can be solved. Accordingly, mounting the liquid-material discharge device 1 of the present embodiment on an application device including a relative movement device makes it possible to draw a line with a uniform width on a work surface. The relative movement device, which includes, for example, a known XYZ-axis servomotor and ball screw, allows the discharge port of the liquid-material discharge device 1 to move toward any position on a work at any speed.

<Second Embodiment>

FIG. 8 illustrates explanatory views of an outer cylinder 210, a stator 211, and a rotor 220 according to a second embodiment. (a) is a side sectional view when the rotor 220 is at its highest position (0°), (b) is a back view, (c) is a B-B sectional view of (a), (d) is a C-C sectional view of (a), (e) is a side sectional view of the outer cylinder 210 only, and (f) is a back view of the outer cylinder 210. It should be noted that, in the second embodiment, components other than the outer cylinder 210 and the stator 211 are similar to those of the first embodiment, and thus will not be described.

As illustrated in FIG. 8 (a) and (e), an inner diameter of the outer cylinder 210 of the present embodiment gets gradually larger near both of the end portions than at the central portion. The outer cylinder 210 includes an inlet-side inner periphery 210*a* that has a tapered shape of which diameter increases toward the inlet, an outlet-side inner periphery 210*b* that has a tapered shape of which diameter increases toward the outlet, and a central portion inner periphery 210*c* that forms a cylindrical space of which diameter is constant through the longitudinal direction. In this way, the inner periphery of the outer cylinder 210 is beveled such that the diameter increases from the central portion toward the inlet and the outlet, and forms truncated-cone-shaped spaces at an upstream end portion and a downstream end portion. That is, the diameter of the outer cylinder 210 of the second embodiment increases stepwise (in other words, gradually) at positions corresponding to the inlet portion and the outlet portion of an insertion hole 212. Here, the concept of increasing a diameter stepwise (in other words, gradually) is not limited to the mode where the diameter increases steplessly as illustrated in FIG. 8. The present invention also includes a mode where it decreases unevenly stepwise.

As illustrated in FIG. 8 (c), when the rotor 220 is at its highest position, a transport space 221*c* is formed below the rotor 220 at a B-B line position. When the rotor 220 rotates from the illustrated position, while a sectional area of the transport space 221*c* below the rotor 220 shrinks, a transport space 222*c* (not shown) is created above the rotor 220 and a sectional area thereof further expands along with the rotation of the rotor 220. As illustrated in FIG. 8 (a), when the rotor 220 is at its highest position, a transport space 221*a* having the maximum opening area is formed below the rotor 220 at the most upstream point. When the rotor 220 rotates from the illustrated position, a transport space 222*a* (not shown) that functions as the inlet of the transport path is dynamically formed above the rotor 220, and the opening area of the transport space 221*a* shrinks.

As illustrated in FIG. 8 (d), transport spaces 223, 224 are formed on the right and left sides of the rotor 220 at a C-C line position. Here, the transport space 223 communicates with the transport space 221*c* to form a cavity, and the transport space 224 communicates with the transport space 222*c* to form another cavity. When the rotor 220 rotates from the illustrated position, a sectional area of one of the transport spaces 223, 224 on the right and left sides of the rotor 220 shrinks, and a sectional area of the other expands. For example, when the rotor 220 rotates from 0° to 90°, the transport space 223 is closed and the sectional area of the transport space 224 is maximized.

In this way, the rotation of the rotor 220 causes repetition of the motion of forming and closing transport spaces of the two lines at opposite positions across the rotor 220 in each section (including the B-B section and the C-C section) perpendicular to the flow-path direction of the stator 211, resulting in transportation of the liquid material within the insertion hole 212.

The stator 211 made of elastic material is arranged in tight contact with the inner peripheries (210*a*, 210*b*, 210*c*) of the outer cylinder 210. The stator 211 is fixed to the stator 211 to prevent relative position misalignment between the outer cylinder 210 and the stator 211 due to rotational movement of the stator 211 with respect to the outer cylinder 210 caused by the rotating motion of the rotor 220. For example, the outer cylinder 210 and the stator 211 are adhered to each other. As can be seen from interference $S_{211}$, $S_{212}$ drawn in black in FIG. 8 (a), an amount of the interference $S_{211}$, $S_{212}$ is constant over a longitudinally central portion 211*c* of the stator 1 whereas the amount of the interference $S_{211}$, $S_{212}$ gradually decreases at an inlet portion 211*a* and an outlet portion 211*b*. In addition, the stator 211 is thicker at the inlet portion 211*a* and the outlet portion 211*b* than at the longitudinally central portion 211*c*. Thus, contact force between the rotor 220 and the stator 211 is much weaker at the inlet portion and the outlet portion than at the central portion. That is, the second embodiment yields a larger difference in the contact force between the longitudinally central portion and the inlet and outlet portions of the stator 211 than the first embodiment.

In the present embodiment, the stator 211 includes the inlet portion 211*a* and the outlet portion 211*b* of which thickness in the radial direction increases gradually (stepwise) toward the end portions, and thus the contact force between the rotor 220 and the stator 211 diminishes gradually (stepwise) toward the end portions. Note that the mode where the outer cylinder 210 is thinner in the radial direction at both of the end portions than at the central portion is not limited to the mode of the second embodiment. For example, the thickness of the outer cylinder 210 in the radial direction may decrease from the central portion toward the upstream end portion and the downstream end portion so as to draw a parabolic round shape, or may decrease in steps.

In the second embodiment as described above, the interference $S_{211}$, $S_{212}$ is smaller near both of the end portions (at the inlet portion and the outlet portion) of the stator 211 than at the central portion, and the contact force between the rotor 220 and the stator 211 is weaker at the inlet portion and the outlet portion of the insertion hole 212 than at the central portion. Therefore, the problem of pulsation can be solved. Accordingly, mounting the liquid-material discharge device 1 of the present embodiment on an application device including a relative movement device makes it possible to draw a line with a uniform width on a work surface.

In addition, the inner diameter of the outer cylinder 210 at both of the end portions is made larger than that at the central portion so that the diameter of the stator 211 at the inlet portion 211*a* and the outlet portion 211*b* smoothly increases, which results in gradual (stepwise) increase in the thickness in the radial direction toward the end portions. Therefore, it is possible to smoothly accept the liquid material into the inlet of the stator 211 and to smoothly exhaust the liquid material from the outlet.

<Third Embodiment>

FIG. 9 illustrates explanatory views of an outer cylinder 310, a stator 311, and a rotor 320 according to a third embodiment. (a) is a side sectional view when the rotor 320 is at its highest position (0°), (b) is a back view, (c) is a B-B sectional view of (a), (d) is a C-C sectional view of (a), (e) is a side sectional view of the outer cylinder 310 only, and (f) is a back view of the outer cylinder 310. It should be noted that, in the third embodiment, components other than the outer cylinder 310 and the stator 311 are similar to those of the first embodiment, and thus will not be described.

As illustrated in FIG. 9 (a) and (e), the outer cylinder 310 of the present embodiment includes an inlet-side inner periphery 310*a* that has a tapered shape of which diameter increases toward the inlet, an outlet-side inner periphery 310*b* that has a tapered shape of which diameter increases toward the outlet, and a central portion inner periphery 310*c* having a female-screw-shaped inner periphery with the same pitch as a female screw shape of an inner periphery of the stator 311. The outer cylinder 310 is the same as the second embodiment in that it has truncated-cone-shaped spaces at the upstream end portion and the downstream end portion, but is different in that the central portion inner periphery 310*c* has a female screw shape.

The inner periphery of the central portion of the stator 311 has a female screw shape with the same pitch as the rotor 320, and an outer periphery of the central portion of the stator 311 has a male screw shape with the same pitch as the inner periphery. The stator 311 made of elastic material is arranged in tight contact with the inner peripheries (310*a*, 310*b*, 310*c*) of the outer cylinder 310.

In the third embodiment, the central portion inner periphery 310*c* of the outer cylinder has a female screw shape with the same pitch as the female screw shape of the inner periphery of the central portion of the stator 311 so that the thickness of the longitudinally central portion of the stator 311 can be uniform. Therefore, contact force with the rotor 320 can be uniform over the central portion. When the stator 311 and the rotor 320 form a transport path in cooperation, a trajectory along which the rotor 320 operates is affected by repulsive force generated in elastic deformation of the stator 311. However, this repulsive force is constant all around a contact surface with the rotor 320 within the range of the central portion inner periphery 310*c*. Therefore, in the third embodiment, the trajectory along which the rotor 320 operates is steady, resulting in stable construction of the transport path. In other words, in the third embodiment, a posture of the rotor 320 is stable all around, which results in a constant shape of cavities.

As illustrated in FIG. 9 (b), when the rotor 320 is at its highest position, a transport space 321*a* having the maximum opening area is formed below the rotor 320 at the most upstream point. When the rotor 320 rotates from the illustrated position, a transport space 322*a* (not shown) is dynamically formed above the rotor 320 at the most upstream point, and the opening area of the transport space 321*a* shrinks.

As illustrated in FIG. 9 (c), a transport space 321*c* is formed below the rotor 320 at a B-B line position. When the rotor 320 rotates from the illustrated position, while a sectional area of the transport space 321*c* below the rotor 320 shrinks, a transport space 322*c* (not shown) is created above the rotor 320 and a sectional area thereof further expands along with the rotation of the rotor 320.

As illustrated in FIG. 9 (d), transport spaces 323, 324 are formed on the right and left sides of the rotor 320 at a C-C line position. Here, the transport space 323 communicates with the transport space 321*c* to form a cavity, and the transport space 324 communicates with the transport space 322*c* to form another cavity. When the rotor 320 rotates from the illustrated position, a sectional area of one of the transport spaces 323, 324 on the right and left sides of the rotor 320 shrinks, and a sectional area of the other expands. For example, when the rotor 320 rotates from 0° to 90°, the transport space 323 is closed and the sectional area of the transport space 324 is maximized.

In this way, the rotation of the rotor 320 causes repetition of the motion of forming and closing transport spaces of the two lines at opposite positions across the rotor 320 in each section (including the B-B section and the C-C section) perpendicular to the flow-path direction of the stator 311, resulting in transportation of the liquid material within the insertion hole 312.

As can be seen from an amount of interference $S_{311}$, $S_{312}$ drawn in black in FIG. 9 (a), the amount of the interference $S_{311}$, $S_{312}$ is smaller at an inlet portion 311*a* and an outlet portion 311*b* than at a central portion 311*c* of the stator 311. Thus, the adjustment of the amount of interference also causes the contact force with the rotor 320 to be smaller at the inlet portion and the outlet portion of the stator 311 than at the central portion.

In addition, as illustrated in FIG. 9 (c) and (d), the thickness in the radial direction at the central portion 311*c* of the stator 311 is thinner than that at the central portion 211*c* of the stator 211 of the second embodiment. Therefore, the third embodiment yields a larger difference in the contact force with the rotor 320 between the longitudinally central portion and the inlet and outlet portions of the stator 311 than the second embodiment.

Also in the third embodiment as described above, the contact force with the rotor 320 is weaker at the inlet portion and the outlet portion of the stator 311 than at the longitudinally central portion. Therefore, the problem of pulsation can be solved. Accordingly, mounting the liquid-material discharge device 1 of the present embodiment on an application device including a relative movement device makes it possible to draw a line with a uniform width on a work surface. In addition, it is possible to arrange the difference in the contact force between the longitudinally central portion and the inlet and outlet portions of the stator 311 to be larger than that of the second embodiment.

<Fourth Embodiment>

FIG. 10 illustrates explanatory views of an outer cylinder 410, a stator 411, and a rotor 420 according to a fourth embodiment. (a) is a side sectional view when the rotor 420 is at its highest position (0°), (b) is a back view, (c) is a B-B sectional view of (a), (d) is a C-C sectional view of (a), (e) is a side sectional view of the outer cylinder 410 only, and (f) is a back view of the outer cylinder 410. It should be noted that, in the fourth embodiment, components other than the outer cylinder 410 and the stator 411 are similar to those of the first embodiment, and thus will not be described.

As illustrated in FIG. 10 (a) and (e), the outer cylinder 410 of the present embodiment includes an inlet-side inner periphery 410*a* that has a tapered shape of which diameter increases toward the inlet, an outlet-side inner periphery 410*b* that has a tapered shape of which diameter increases toward the outlet, and a central portion inner periphery 410*c* having a female-screw-shaped inner periphery with substantially the same pitch as a female screw shape of an inner periphery of the stator 411. The outer cylinder 410 includes the central portion inner periphery 410*c* having a female screw shape with edges and is thus different from the outer cylinder 310 of the third embodiment having a smooth female screw shape with no edges.

The inner periphery of the central portion of the stator 411 has a female screw shape with the same pitch as the rotor 420, and an outer periphery of the central portion of the stator 411 has a male screw shape having edges with substantially the same pitch as the inner periphery. The stator 411 made of elastic material is arranged in tight contact with the inner peripheries (410*a*, 410*b*, 410*c*) of the outer cylinder 410. As can be seen from interference $S_{411}$, $S_{412}$ drawn in black in FIG. 10 (a), an amount of the interference $S_{411}$, $S_{412}$ is constant over a central portion 411*c* of the stator 411 whereas the amount of the interference $S_{411}$, $S_{412}$ gradually decreases at an inlet portion 411*a* and an outlet portion 411*b*. Thus, the adjustment of the amount of interference also causes contact force with the rotor 420 to be smaller at the inlet portion and the outlet portion of the stator 411 than at the central portion.

As illustrated in FIG. 10 (b), when the rotor 420 is at its highest position, a transport space 421*a* having the maximum opening area is formed below the rotor 420 at the most upstream point.

In addition, as illustrated in FIG. 10 (c) and (d), the thickness in the radial direction at the central portion 411*c* of the stator 411 is thinner than that at the central portion 211*c* of the stator 211 of the second embodiment. Therefore, the difference in the contact force with the rotor 420 between the longitudinally central portion and the inlet and outlet portions of the stator 411 is larger than that of the second embodiment.

Also in the fourth embodiment as described above, the contact force with the rotor 420 is weaker at the inlet portion and the outlet portion of the stator 411 than at the central portion. Therefore, the problem of pulsation can be solved. Accordingly, mounting the liquid-material discharge device 1 of the present embodiment on an application device including a relative movement device makes it possible to draw a line with a uniform width on a work surface. Compared to the outer cylinder 310 of the third embodiment, the shape of the outer cylinder 410 of the fourth embodiment imposes fewer restrictions on cutting work to form it. Therefore, manufacturing cost can be reduced.

<Fifth Embodiment>

FIG. 11 illustrates explanatory views of an outer cylinder 510, a stator 511, and a rotor 520 according to a fifth embodiment. (a) is a side sectional view when the rotor 520 is at its highest position (0°), (b) is a back view, (c) is a B-B sectional view of (a), (d) is a C-C sectional view of (a), (e) is a side sectional view of the outer cylinder 510 only, and (f) is a back view of the outer cylinder 510. It should be noted that, in the fifth embodiment, components other than the outer cylinder 510 and the stator 511 are similar to those of the first embodiment, and thus will not be described.

As illustrated in FIG. 11 (a) and (d), the outer cylinder 510 of the present embodiment includes an upstream end portion inner periphery 510*a* that forms a cylindrical space of which diameter is constant through the longitudinal direction, a downstream end portion inner periphery 510*b* that forms a cylindrical space of which diameter is constant through the longitudinal direction, a central portion inner periphery 510*c* that forms a cylindrical space of which diameter is constant through the longitudinal direction, an inlet-side tapered surface 510*d*, and an outlet-side tapered surface 510*e*. An inner periphery of the stator 511 has a female screw shape with the same pitch as the rotor 520, and an outer periphery of the stator 511 has the same shape as the inner peripheries of the outer cylinder 510. The stator 511 made of elastic material is arranged in tight contact with the inner peripheries (510*a* to 510*e*) of the outer cylinder 510.

As illustrated in FIG. 11 (b), when the rotor 520 is at its highest position, a transport space 521*a* having the maximum opening area is formed below the rotor 520 at the most upstream point.

In the outer cylinder 510 of the present embodiment, the upstream end portion inner periphery 510*a* and the downstream end portion inner periphery 510*b* have a cylindrical shape that is larger in diameter than the central portion inner periphery 510*c* so that contact force with the rotor 520 can be relatively weak over respective certain ranges from the inlet and the outlet of the stator 511. Here, the upstream end portion inner periphery 510*a* of the outer cylinder is formed preferably over a length of one to two turns of the rotor 520 from the inlet-side end portion of the stator 511, and the downstream end portion inner periphery 510*b* is formed preferably over a length of one turn of the rotor 520 from the outlet-side end portion of the stator 511.

In addition, in the outer cylinder 510 of the present embodiment, a longitudinal range (length) of the upstream end portion inner periphery 510*a* is longer than a longitudinal range (length) of the downstream end portion inner periphery 510*b* so that the liquid material can be smoothly accepted into a transport path formed within an insertion hole 512. In more detail, the length of the upstream end portion inner periphery 510*a* of the outer cylinder is preferably one turn of the rotor 520 or more from the inlet-side end portion. Furthermore, it is more preferable to allow the contact force to be weak within a range of 1.5 turns of the rotor 520 in order to allow the contact force to be sufficiently weak without being affected by manufacturing tolerance or the like. The relatively long inlet portion of the transport path formed within the insertion hole 512 is effective for accepting sufficient liquid material and preventing pulsation.

In the outer cylinder 510 of the present embodiment, the thickness of the stator 511 in the radial direction increases gradually toward both of the end portions due to the inlet-side tapered surface 510*d* of which diameter increases toward the inlet and the outlet-side tapered surface 510*e* of which diameter increases toward the outlet, which also causes the contact force between the rotor 520 and the stator 511 to diminish gradually (stepwise) toward both of the end portions. A range of an inlet portion 511*a* of the stator 511 of the fifth embodiment corresponds to the upstream end portion inner periphery 510*a* and the inlet-side tapered surface 510*d* of the outer cylinder. A range of an outlet portion 511*b* of the stator 511 of the fifth embodiment corresponds to the downstream end portion inner periphery 510*b* and the outlet-side tapered surface 510*e* of the outer cylinder, and is shorter than that of the inlet portion 511*a* of the stator 511. Pulsation can also be prevented in the mode according to the fifth embodiment where the contact force by the rotor 520 gradually (stepwise) diminishes on a boundary between the central portion and the inlet portion (or the outlet portion) of the stator 511, and the contact force by the rotor 520 is constant in a place closer to the inlet (or the outlet) than the boundary. That is, the technical idea of decreasing the contact force by the rotor 520 gradually (stepwise) from the longitudinally central portion of the stator 511 toward the outlet and the inlet also encompasses the mode according to the fifth embodiment where the tapered surfaces not adjacent to the outlet and the inlet are provided to inner peripheries of the outer cylinder 510.

As can be seen from interference $S_{511}$, $S_{512}$ drawn in black in FIG. 11 (a), an amount of the interference $S_{511}$, $S_{512}$ is smaller at the inlet portion 511*a* and the outlet portion 511*b* than at a central portion 511*c* of the stator 511 where the amount of the interference $S_{511}$, $S_{512}$ is constant. Thus, the adjustment of the amount of interference also causes the contact force with the rotor 520 to be smaller at the inlet portion and the outlet portion of the stator 511.

Also in the fifth embodiment as described above, the contact force with the rotor 520 is weaker at the inlet portion and the outlet portion of the stator 511 than at the longitudinally central portion. Therefore, the problem of pulsation can be solved. Accordingly, mounting the liquid-material discharge device 1 of the present embodiment on an application device including a relative movement device makes it possible to draw a line with a uniform width on a work surface. In addition, a range of the increased inner periphery diameter of the inlet portion of the outer cylinder 510 is longer than those of the second to fourth embodiments so that the contact force at the inlet portion of the insertion hole 512 can diminish within the longer range and the liquid material can be further smoothly accepted into the transport path formed within the insertion hole 512. Such an arrangement where the range of the inlet portion of the stator 511 with the increased inner periphery diameter is longer than that of the outlet portion can also be combined with and applied to the examples in the third and fourth embodiments.

<Sixth Embodiment>

FIG. 12 illustrates explanatory views of an outer cylinder 610, a stator 611, and a rotor 620 according to a sixth embodiment. (a) is a side sectional view when the rotor 620 is at its highest position (0°), (b) is an A-A sectional view of (a), (c) is a B-B sectional view of (a), (d) is a C-C sectional view of (a), and (e) is a back view with the rotor 620 omitted. It should be noted that, in the sixth embodiment, components other than the outer cylinder 610 and the stator 611 are similar to those of the first embodiment, and thus will not be described.

As illustrated in FIG. 12 (a), the outer cylinder 610 of the present embodiment includes an upstream end portion inner periphery 610*a* that forms a cylindrical space of which diameter is constant through the longitudinal direction, a downstream end portion inner periphery 610*b* that forms a cylindrical space of which diameter is constant through the longitudinal direction, a central portion inner periphery 610*c* that forms a cylindrical space of which diameter is constant through the longitudinal direction, an inlet-side tapered surface 610*d*, and an outlet-side tapered surface 610*e*. An inner periphery of the stator 611 has a female screw shape with the same pitch as the rotor 620, and an outer periphery of the stator 611 has the same shape as the inner peripheries of the outer cylinder 610. The stator 611 made of elastic material is arranged in tight contact with the inner peripheries (610*a* to 610*e*) of the outer cylinder 610.

In the outer cylinder 610 of the present embodiment, the upstream end portion inner periphery 610*a* and the downstream end portion inner periphery 610*b* have a cylindrical shape that is larger in diameter than the central portion inner periphery 610*c* so that contact force with the rotor 620 can be relatively weak over respective certain ranges from the inlet and the outlet of the stator 611.

In addition, in the outer cylinder 610 of the present embodiment, as in the fifth embodiment, a longitudinal range (length) of the upstream end portion inner periphery 610*a* of the outer cylinder is longer than a range (length) of the downstream end portion inner periphery 610*b* so that the liquid material can be smoothly accepted into a transport path formed within an insertion hole 612, and pulsation can thereby be effectively prevented.

In the present embodiment, an acceptance space 621*a* is provided adjacent to the inlet portion of the stator 611. An inner diameter of the acceptance space 621*a* is sized such that the stator 611 is not in contact with the rotor 620 rotating in the acceptance space 621*a*. In the acceptance space 621*a*, the inner periphery of the stator 611 is not in contact with the rotor 620 at all times. Thus, the acceptance space 621*a* is a non-transport action zone that does not exert an action of transferring the liquid material. That is, the insertion hole 612 of the stator 611 of the present embodiment is divided into a transport action zone and the non-transport action zone. A boundary between the transport action zone and the non-transport action zone in the insertion hole 612 is located at the most upstream position in the range where the rotor 620 is in contact with the stator 611, and is denoted with reference symbol 612*a* in FIG. 12 (a). The place indicated by reference symbol 612*a* is a start position of the transport path, and is an inlet of the transport path. A downstream side from reference symbol 612*a* is the transport path that exerts the liquid-material transport action. This transport path is a flow path that appears by inserting the rotor 620 having a male-screw-shaped outer periphery into the insertion hole 612, and eccentric rotation of the rotor 620 within the insertion hole 612 leads to movement of cavities sequentially formed within the transport path and transfer of the liquid material filling the cavities. The acceptance space 621*a*, which is a space adjacent to the inlet of the transport path, increases in diameter toward an upstream side from the inlet of the transport path.

As illustrated in FIG. 12 (c), there is a gap between the inner periphery of the stator 611 forming the acceptance space 621*a* and the outer periphery of the rotor 620. From another viewpoint, an inner diameter of the insertion hole 612 of the stator 611 is the largest at a most-upstream-side end portion. Furthermore, the acceptance space 621*a* has a smaller capacity than any cavity formed within the insertion hole 612 downstream of the acceptance space 621*a*.

In the present embodiment, the thickness of the stator 611 in the radial direction increases gradually toward the end portions due to the inlet-side tapered surface 610*d* of the outer cylinder of which diameter increases toward the inlet and the outlet-side tapered surface 610*e* of which diameter increases toward the outlet, which also causes the contact force between the rotor 620 and the stator 611 to diminish gradually (stepwise) toward the end portions. Furthermore, in the present embodiment, the contact force between the stator 611 and the rotor 620 is zero on the upstream side from the inlet of the transport path.

A range of an inlet portion 611*a* of the stator 611 of the present embodiment corresponds to the upstream end portion inner periphery 610*a* and the inlet-side tapered surface 610*d* of the outer cylinder 610 in the transport action zone, and does not include the non-transport action zone.

A range of an outlet portion 611*b* of the stator 611 of the present embodiment corresponds to the downstream end portion inner periphery 610*b* and the outlet-side tapered surface 610*e* of the outer cylinder 610, and is shorter than the inlet portion 611*a* of the stator 611. The stator 611 of the present embodiment does not have a non-transport action zone at the outlet portion 611*b*, but if it includes a non-transport action zone at the outlet portion, the outlet portion does not include this non-transport action zone.

A length of a longitudinally central portion 611*c* of the stator 611 of the present embodiment is at least twice the length of the inlet portion of the stator 611.

In the stator 611 of the present embodiment, the amount of interference is constant at the longitudinally central portion, but decreases gradually (stepwise) from a boundary with the central portion toward the boundary 612*a* with the acceptance space. Furthermore, in the stator 611, the amount of interference decreases gradually (stepwise) from another boundary with the longitudinally central portion toward the outlet. The thickness of the stator 611 in the radial direction is thick at the inlet portion 611*a* and the outlet portion 611*b* also due to the increased inner diameter of the upstream end portion inner periphery 610*a* and the downstream end portion inner periphery 610*b* of the outer cylinder 610. Therefore, the contact force at the inlet portion and the outlet portion of the insertion hole 612 gradually (stepwise) diminishes. In addition, the inner periphery of the stator 611 is provided with the tapered surface of which diameter increases toward the upstream side to form the acceptance space 621*a* near the inlet of the insertion hole 612 so that a sufficient amount of the liquid material can be supplied to always fill cavities formed within the insertion hole 612.

In the sixth embodiment as described above, the contact force between the rotor 520 and the stator 511 is weaker at the inlet portion and the outlet portion of the insertion hole 612 than at the central portion, and the acceptance space 621*a* with the increased diameter is further provided near the inlet for smooth inflow of the liquid material. Therefore, the problem of pulsation can be solved. Accordingly, mounting the liquid-material discharge device 1 of the present embodiment on an application device including a relative movement device makes it possible to draw a line with a uniform width on a work surface. It should be noted that, in the present embodiment, the non-transport action zone is provided only at the inlet portion of the insertion hole 612, but the non-transport action zone may also be provided at the outlet portion of the insertion hole 612.

The preferred embodiments of the present invention have been described above. However, the technical scope of the present invention is not limited to the description of the above embodiments. Various alterations and modifications can be applied without departing from the technical idea of the present invention, and such altered or modified modes also fall within the technical scope of the present invention.

For example, in each figure of the above embodiments 1 to 6, both of the inner periphery diameters of the upstream end portion and the downstream end portion of the outer cylinder are the same. However, the technical scope of the present invention also includes a mode where the inner periphery diameters of the upstream end portion and the downstream end portion of the outer cylinder are different, and a mode where taper angles thereof are different.

In addition, in the above embodiments 1 to 6, for example, the capacity of a transport space at the inlet portion and/or the outlet portion of the insertion hole (12, 212, 312, 412, 512) may be larger than the capacity of the transport space at the longitudinally central portion of the insertion hole (12, 212, 312, 412, 512). Such a configuration allows the liquid material that has moved in the transport space within the insertion hole to be exhausted in a flow with less pulsation.

Furthermore, in the above embodiments 1 to 6, for example, the rotor (20, 220, 320, 420, 520, 620) may be thicker at the longitudinally central portion than at the inlet portion and the outlet portion. Such a configuration allows, even when the inner diameter of the insertion hole of the stator is constant from the inlet to the outlet, the contact force between the rotor and the stator at the inlet portion and the outlet portion of the insertion hole to be smaller than the contact force between the rotor and the stator at the longitudinally central portion of the insertion hole.

Furthermore, in the above embodiments 1 to 6, for example, the elasticity of the stator per unit volume at the longitudinally central portion may be larger than the elasticity per unit volume at the inlet portion and/or the outlet portion. As a concrete example, it is disclosed that the longitudinally central portion of the stator is constituted of an elastic body (for example, rubber) that is denser than an elastic body constituting the inlet portion and/or the outlet portion.

Furthermore, the liquid-material discharge device of the above embodiments 1 to 6 can be used not only for the purpose of applying a liquid material but also as a liquid feed pump of a circulation circuit or the like. It can also be used as a suction pump by rotating the rotor inversely with the above embodiments 1 to 6.

It is also possible to combine the above embodiments 1 to 6 to solve the problem to be solved by the invention. That is, it is possible to adopt any one of solutions of the above embodiments 1 to 6 at the inlet portion of the insertion hole (12, 212, 312, 412, 512, 612), and any one of solutions of the above embodiments 1 to 5 that is different from the inlet portion at the outlet portion of the insertion hole (12, 212, 10 312, 412, 512, 612). For example, the following combination is also possible.

(A) There is provided an arrangement where the thickness of interference in the radial direction at the inlet portion (or outlet portion) of the insertion hole increases stepwise by arranging the corresponding inner diameter of the outer cylinder to increase stepwise, and the amount of interference at the outlet portion (or inlet portion) of the insertion hole decreases stepwise while the corresponding inner diameter of the outer cylinder is kept constant, whereby the contact force between the rotor and the stator at the inlet portion and the outlet portion of the insertion hole is smaller than the contact force between the rotor and the stator at the longitudinally central portion of the insertion hole.

(B) There is provided an arrangement where the thickness of interference in the radial direction at the inlet portion (or outlet portion) of the insertion hole increases stepwise by arranging the corresponding inner diameter of the outer cylinder to increase stepwise, and the stator at the outlet portion (or inlet portion) of the insertion hole is made of material with weaker elasticity than that at the central portion while the corresponding inner diameter of the outer cylinder is kept constant.

(C) There is provided an arrangement where the amount of interference at the outlet portion (or inlet portion) of the insertion hole decreases stepwise while the inner diameter of the outer cylinder is kept constant over the entire length, whereby the contact force between the rotor and the stator at the inlet portion and the outlet portion of the insertion hole is smaller than the contact force between the rotor and the stator at the longitudinally central portion of the insertion hole, as well as an arrangement where the stator at the inlet portion (or outlet portion) of the insertion hole is made of material with weaker elasticity than that at the central portion.

(D) An acceptance space is provided in (A) to (C) described above, wherein the acceptance space is a space located near the inlet of the insertion hole where the outer periphery of the rotor and the inner periphery of the stator is not in contact with each other, and the diameter of the acceptance space increases toward the inlet-side end portion of the insertion hole.

List of Reference Symbols

1: liquid-material discharge device/2: main body/3: rotor driving device/10, 110, 210, 310, 410, 510: outer cylinder/11, 111, 211, 311, 411, 511: stator/12, 112, 212, 312, 412, 512: insertion hole/13: nozzle member/14: bubble releasing hole/15: stator unit/20, 120, 220, 320, 420, 520: rotor/21, 121, 221, 321, 421, 521: transport space (below rotor)/22, 122, 222, 322, 422, 522: transport space (above rotor)/23, 123, 223, 323, 423, 523: transport space (right of rotor)/24, 124, 224, 324, 424, 524: transport space (left of rotor)

The invention claimed is:

1. A fluid transfer device comprising:

an outer cylinder;

a stator that has an insertion hole as a female-screw-shaped through-hole and is provided on an inner periphery of the outer cylinder; and a male-screw-shaped rotor that is connected to a rotor driving part and eccentrically rotates in contact with an inner periphery of the stator;

wherein the fluid transfer device is capable of transferring a fluid in a transport path formed by the stator and the rotor, by eccentrically rotating the rotor inserted through the insertion hole;

wherein the stator includes an inlet portion that spans a certain range through a longitudinal direction from an inlet of the transport path, an outlet portion that spans a certain range through the longitudinal direction from an outlet of the transport path, and a central portion located between the inlet portion and the outlet portion;

wherein the stator is subject to smaller contact force by the rotor at the inlet portion and the outlet portion than contact force by the rotor at the central portion.

2. The fluid transfer device according to claim 1, wherein the stator has a smaller amount of interference by the rotor at the inlet portion and the outlet portion than an amount of interference by the rotor at the central portion, whereby the stator is subject to smaller contact force by the rotor at the inlet portion and the outlet portion than contact force by the rotor at the central portion.

3. The fluid transfer device according to claim 2, wherein an amount of interference by the rotor decreases gradually from the central portion toward the outlet or the inlet.

4. The fluid transfer device according to claim 1, wherein contact force by the rotor at the central portion is uniform through the longitudinal direction.

5. The fluid transfer device according to claim 4, wherein (A) contact force A1, A2, A3, A4 satisfies a relationship A4>A2>A3>A1, where A1 denotes contact force between the rotor and the stator at the inlet of the transport path, A2 denotes contact force between the rotor and the stator at a position that is one turn of the rotor from the inlet of the transport path, A3 denotes contact force between the rotor and the stator at a position between the inlet of the transport path and the position that is one turn of the rotor from the inlet of the transport path, and A4 denotes contact force between the rotor and the stator at a longitudinally central portion of the transport path, and (B) contact force B1, B2, B3, B4 satisfies a relationship B4>B2>B3>B1, where B1 denotes contact force between the rotor and the stator at the outlet of the transport path, B2 denotes contact force between the rotor and the stator at a position that is one turn of the rotor from the outlet of the transport path, B3 denotes contact force between the rotor and the stator at a position between the outlet of the transport path and the position that is one turn of the rotor from the outlet of the transport path, and B4 denotes contact force between the rotor and the stator at the longitudinally central portion of the transport path.

6. The fluid transfer device according to claim 1, wherein an amount of interference by the rotor at a longitudinally central portion of the insertion hole is uniform through the longitudinal direction.

7. The fluid transfer device according to claim 6, wherein (A) amounts of interference A1, A2, A3, A4 satisfy a relationship A4>A2>A3>A1, where A1 denotes an amount of interference between the rotor and the stator at the inlet of the transport path, A2 denotes an amount of interference between the rotor and the stator at a position that is one turn of the rotor from the inlet of the transport path, A3 denotes an amount of interference between the rotor and the stator at a position between the inlet of the transport path and the position that is one turn of the rotor from the inlet of the transport path, and A4 denotes an amount of interference between the rotor and the stator at a longitudinally central portion of the transport path, and (B) amounts of interference B1, B2, B3, B4 satisfy a relationship B4>B2>B3>B1, where B1 denotes an amount of interference between the rotor and the stator at the outlet of the transport path, B2 denotes an amount of interference between the rotor and the stator at a position that is one turn of the rotor from the outlet of the transport path, B3 denotes an amount of interference between the rotor and the stator at a position between the outlet of the transport path and the position that is one turn of the rotor from the outlet of the transport path, and B4 denotes an amount of interference between the rotor and the stator at the longitudinally central portion of the transport path.

8. The fluid transfer device according to claim 4, wherein a longitudinally central portion of the insertion hole spans a range of two turns of the rotor or more.

9. The fluid transfer device according to claim 4, wherein the inlet portion is within a range exceeding one turn of the rotor from the inlet of the transport path; and the outlet portion is within a range exceeding one turn of the rotor from the outlet of the transport path.

10. The fluid transfer device according to claim 4, wherein a longitudinal range of the central portion of the stator is longer than respective longitudinal ranges of the inlet portion and the outlet portion.

11. The fluid transfer device according to claim 4, wherein an interference amount ratio of interference by the rotor at the inlet portion and the outlet portion of the stator to interference by the rotor at the central portion of the stator is within 0.4:1 to 0.7:1.

12. The fluid transfer device according to claim 1, wherein a shape and/or a material property of the inlet portion and the outlet portion of the stator is specified differently from the central portion of the stator such that contact force with the rotor at the inlet portion and the outlet portion is smaller than contact force with the rotor at the central portion.

13. The fluid transfer device according to claim 1, wherein either one element of a material property and a thickness of the stator, along with an amount of interference of the stator, at an inlet portion of the transport path, is specified differently from a central portion of the insertion hole such that contact force with the rotor at the inlet portion of the stator is smaller than contact force with the rotor at the central portion of the stator; and either one element of a material property and a thickness of the stator, along with an amount of interference of the stator, at an outlet portion of the transport path, is specified differently from the central portion of the insertion hole such that contact force with the rotor at the outlet portion of the stator is smaller than contact force with the rotor at the central portion of the stator.

14. The fluid transfer device according to claim 1, wherein the longitudinally central portion of the stator is made of material with greater elasticity than material of the inlet portion and/or the outlet portion of the stator.

15. The fluid transfer device according to claim 1, wherein an upstream end portion and a downstream end portion of the outer cylinder have inner peripheries with a larger diameter than a longitudinally central portion of the outer cylinder.

16. The fluid transfer device according to claim 15, wherein the longitudinally central portion of the outer cylinder has an inner periphery with a constant diameter.

17. The fluid transfer device according to claim 16, wherein the longitudinally central portion of the outer cylinder has a female-screw-shaped inner periphery with a same pitch as the stator.

18. The fluid transfer device according to claim 17, wherein an outer periphery of the outer cylinder has an uneven shape at a position corresponding to the female-screw-shaped inner periphery.

19. The fluid transfer device according to claim 15, wherein the inner periphery at the upstream end portion of the outer cylinder is formed by a tapered surface of which diameter increases toward an upstream end of the outer cylinder, and the inner periphery at the downstream end portion of the outer cylinder is formed by a tapered surface of which diameter increases toward a downstream end of the outer cylinder.

20. The fluid transfer device according to claim 15, wherein the outer cylinder includes an upstream end portion inner periphery of which inner periphery diameter is constant, an inlet-side tapered surface connecting the upstream end portion inner periphery with the central portion, a downstream end portion inner periphery of which inner periphery diameter is constant, and an outlet-side tapered surface connecting the downstream end portion inner periphery with the central portion.

21. The fluid transfer device according to claim 15, wherein a range of the inner periphery with the larger diameter at the upstream end portion of the outer cylinder is longer than a range of the inner periphery with the larger diameter at the downstream end portion of the outer cylinder.

22. The fluid transfer device according to claim 4, wherein a ratio of a range of the inlet portion of the stator to a range of the central portion of the stator is within 3:5 to 3:10, and a ratio of a range of the outlet portion of the stator to the range of the central portion of the stator is within 2:5 to 2:10.

23. The fluid transfer device according to claim 1, wherein the stator includes a transport action zone having interference by the rotor and a non-transport action zone that is located on an upstream side from the transport action zone and is not in contact (has no interference) with the rotor.

24. The fluid transfer device according to claim 23, wherein an inner periphery of the insertion hole constituting the non-transport action zone is formed by a tapered surface of which diameter increases from a center side of the insertion hole toward an inlet side.

25. The fluid transfer device according to claim 23, wherein a capacity of the non-transport action zone is smaller than a capacity of any of transport spaces within the insertion hole that are located in the transport action zone and are opened and closed by eccentric rotation of the rotor.

26. The fluid transfer device according to claim 1, wherein contact force with the rotor at the inlet portion and/or the outlet portion of the stator is weakest when the rotor is at a highest position and a lowest position.

27. The fluid transfer device according to claim 1, wherein the fluid transfer device is a liquid-material discharge device further including a nozzle member having a discharge port through which the fluid flowing out from the outlet of the transport path is discharged.

28. An application device comprising:

the fluid transfer device according to claim 1; and a relative movement device that moves the fluid transfer device and an application target relative to each other.

29. An application method of drawing a line with a uniform width on a work surface using the application device according to claim 28.

* * * * *